US010184360B2

(12) United States Patent
Caputo et al.

(10) Patent No.: US 10,184,360 B2
(45) Date of Patent: Jan. 22, 2019

(54) PRESSED EXTRUDED PULLEY

(71) Applicant: BorgWarner Inc., Auburn Hills, MI (US)

(72) Inventors: Marco Caputo, Birmingham, MI (US); Brian Kenyon, Cortland, NY (US); Chad McCloy, Cortland, NY (US); Chris Thomas, Dryden, NY (US)

(73) Assignee: BorgWarner Inc., Auburn Hills, MI (US)

( * ) Notice: Subject to any disclaimer, the term of this patent is extended or adjusted under 35 U.S.C. 154(b) by 45 days.

(21) Appl. No.: 15/434,438

(22) Filed: Feb. 16, 2017

(65) Prior Publication Data

US 2018/0230866 A1 Aug. 16, 2018

(51) Int. Cl.
*F01L 1/344* (2006.01)
*F01L 1/02* (2006.01)

(52) U.S. Cl.
CPC ..... *F01L 1/3442* (2013.01); *F01L 1/024* (2013.01); *F01L 2001/34469* (2013.01)

(58) Field of Classification Search
CPC ..... F01L 1/3442; F01L 1/024; F01L 2001/34469; F01L 1/344; F01L 2001/34479; Y10T 74/2102; Y10T 29/49293
See application file for complete search history.

(56) References Cited

U.S. PATENT DOCUMENTS

| | | | | |
|---|---|---|---|---|
| 7,179,341 | B2 | 2/2007 | Harakawa | |
| 8,171,904 | B2 | 5/2012 | Watanabe | |
| 8,863,709 | B2 | 10/2014 | Tada | |
| 2013/0019829 | A1* | 1/2013 | Weber | F01L 1/3442 123/90.17 |
| 2014/0338618 | A1* | 11/2014 | Kandolf | F01L 1/3442 123/90.15 |
| 2015/0053157 | A1* | 2/2015 | Kandolf | F01L 1/3442 123/90.15 |
| 2015/0330268 | A1* | 11/2015 | Tewes | F01L 1/462 123/90.17 |

* cited by examiner

*Primary Examiner* — Mark Laurenzi
*Assistant Examiner* — Wesley Harris
(74) *Attorney, Agent, or Firm* — Brown & Michaels, PC

(57) ABSTRACT

A pulley for phaser including a toothed outer circumference for accepting a drive force; an inner circumference with at least a first set of lands extending towards a center of the pulley and spaced apart along the inner circumference of the pulley; and an axial retaining feature on the first set of lands for interaction with a corresponding retaining feature of a housing press fit within the inner circumference with the pulley, axially retaining the housing within the pulley.

18 Claims, 24 Drawing Sheets

PRESSED EXTRUDED PULLEY

BACKGROUND OF THE INVENTION

Field of the Invention

The invention pertains to the field of pulleys. More particularly, the invention pertains to pressed extruded pulleys.

Description of Related Art

Currently "cup" shaped pulleys 12 are attached to and form part of the outer housing of a cam timing phaser 10 through bolts 13 as shown in FIG. 1. The bolts 13 extend from a first end plate (not shown), through the phaser 10, to holes 14 within the cup shaped pulley 12. The cup shaped pulley 12, shown in FIG. 2, has a toothed outer circumference 15 and a plate portion 16 connected to the toothed outer circumference 15 forming a concave opening 17 for receiving a housing 18 and a rotor and other associated parts of a phaser. The cup shaped pulley 12 is made of powdered metal (PM). The powdered metal cup shaped pulley 12 requires machining of the plate portion 16 of the cup shaped pulley 12 in order to achieve the flatness required for receiving and adequate fitting of the housing 18 and the rotor of the phaser 10, as well as preventing any leakage of fluid from the phaser 10.

SUMMARY OF THE INVENTION

An extruded pulley is pressed on to a phaser housing and retained rotationally by having either a serrated or splined edge, or having keys or dovetails on the housing with keyways in the pulley for receiving the keys.

DETAILED DESCRIPTION OF THE INVENTION

FIGS. 3-7 show an extruded pulley press fit over a housing such that a housing of a phaser is retained within the extruded pulley axially through keys of the housing received within keyways of the extruded pulley.

Figure 1:
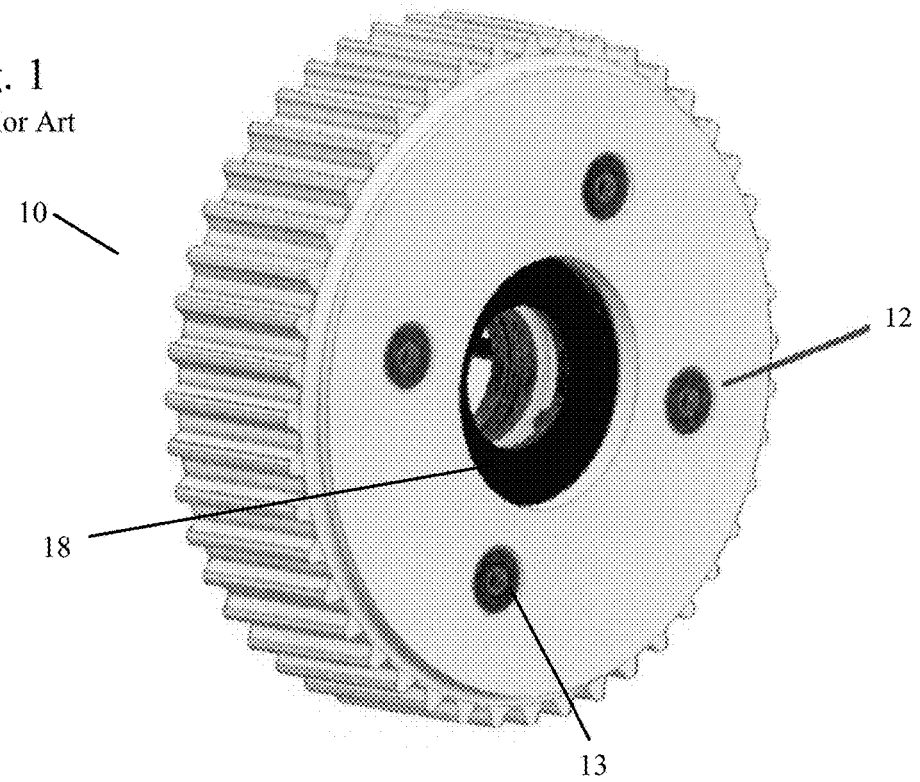
Fig. 1 Prior Art
FIG. 1 shows a perspective view of a phaser with a conventional cup shaped pulley.
Figure 2:
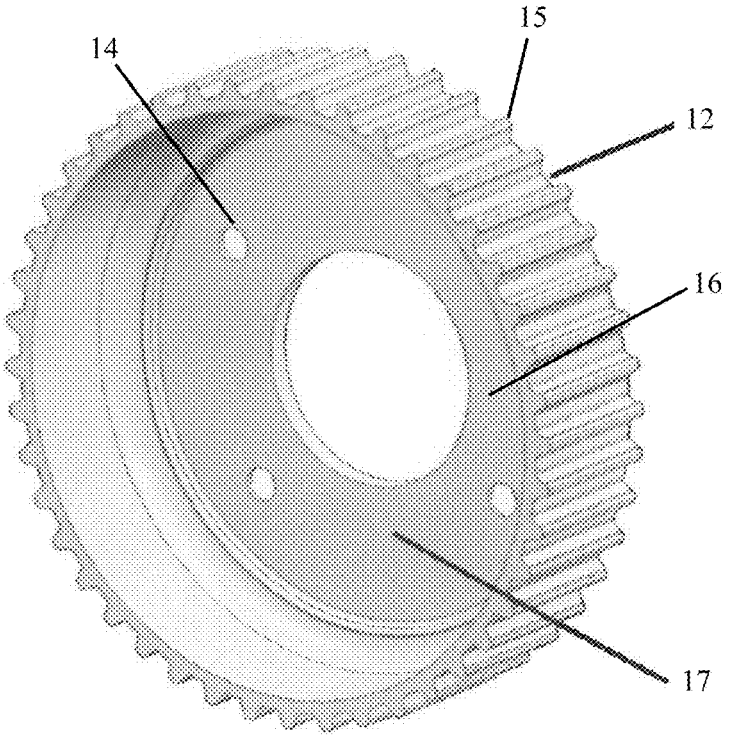
Fig. 2 Prior Art
FIG. 2 shows a perspective view of a conventional cup shaped pulley.
Figure 3:
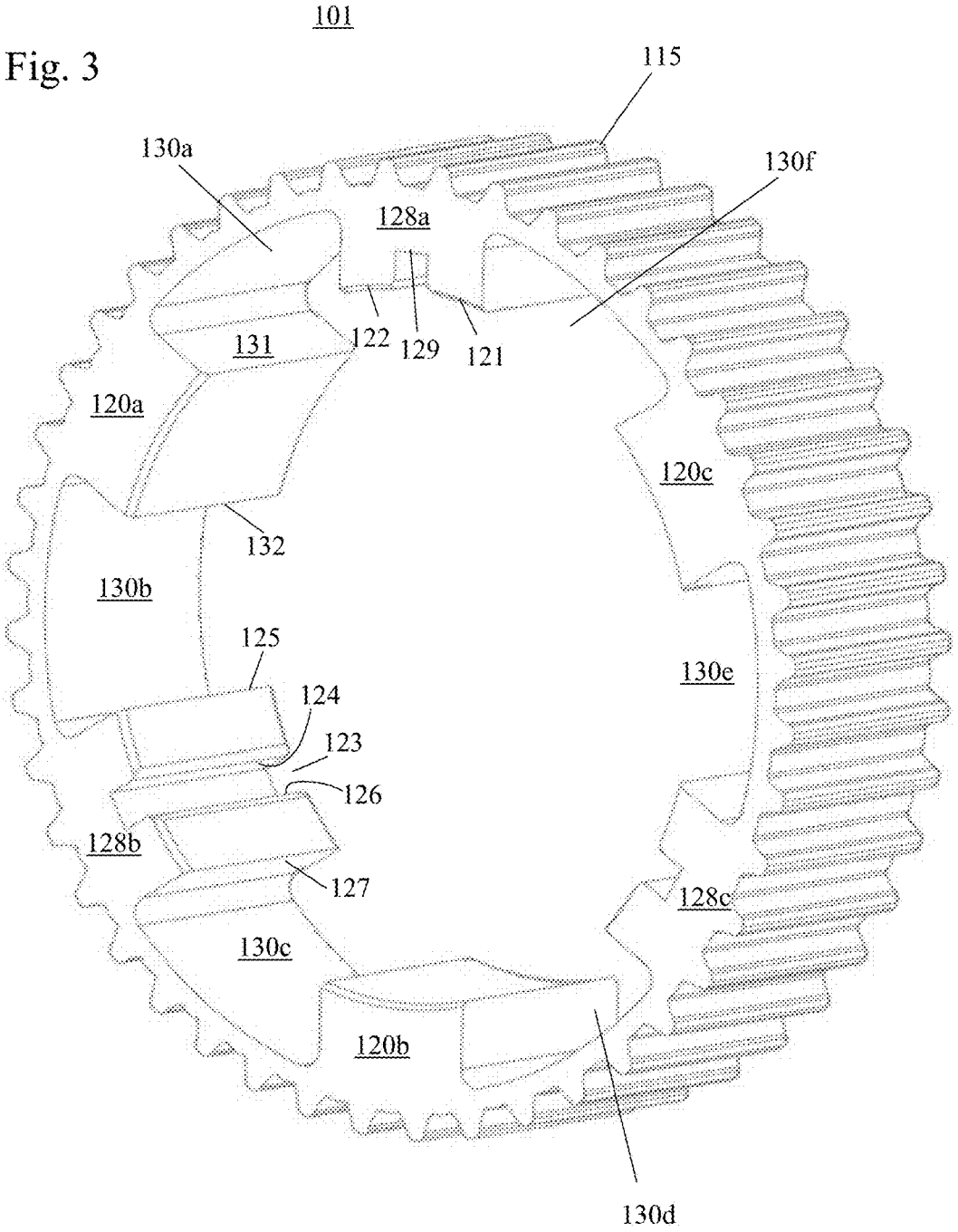
FIG. 3 shows a perspective view of an extruded pulley with a plurality of keyways for receiving a plurality of keys of a housing of a phaser.
Figure 4:
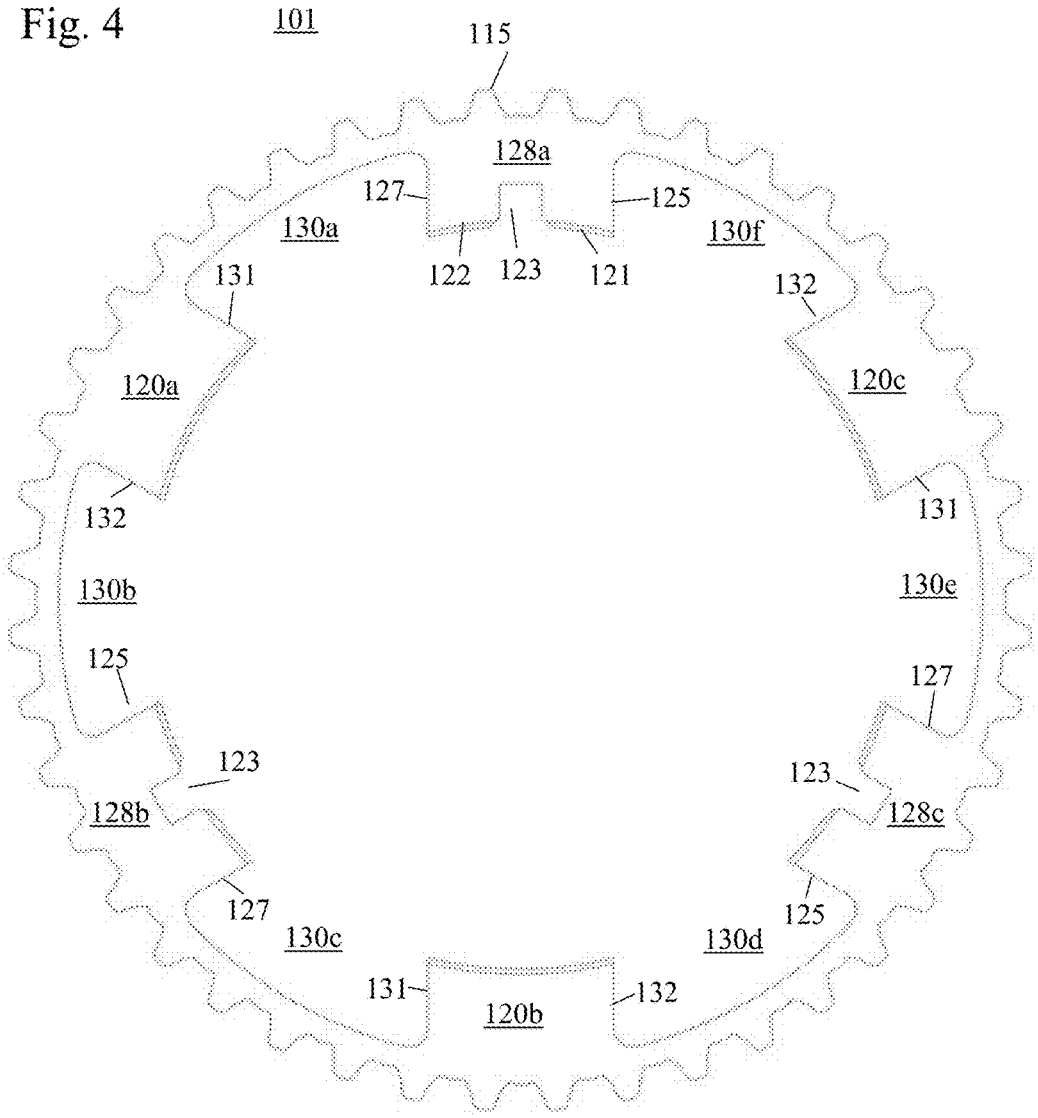
FIG. 4 shows a front view of an extruded pulley with a plurality of keyways for receiving a plurality of keys of a housing of a phaser.

FIGS. 3 and 4 show an extruded pulley 101. The extruded pulley 101 has an outer circumference with a plurality of teeth 115 for accepting a drive force. The inner circumference of the extruded pulley 101 has a plurality of first lands 120*a*-120*c*, and a plurality of second lands 128*a*-128*c* containing keyways 123. The lands 120*a*-120*c*, 128*a*-128*c* extend inwards from the inner circumference towards a center point of the extruded pulley 101.

The plurality of first lands 120*a*-120*c* have a first side wall 131 and a second side wall 132.

Each of the second lands 128*a*-128*c* contains a keyway 123. The keyway 123 is formed by walls of two shoulders 121, 122. The first shoulder 121 has an outer wall 125 and an inner wall 124. The second shoulder has an outer wall 127 and an inner wall 126. The keyway 123 is formed by three walls, the inner wall 124 of the first shoulder 121, the inner wall 126 of the second shoulder, and a third wall 129 of the second land 128*a*-128*c*. The keyway 123 receives a key 157 formed on an outer circumference of a housing 150 shown in FIGS. 5-7.

The second lands 128*a*-128*c* alternate with the first lands 120*a*-120*c* within the inner circumference of the extruded pulley. Windows 130*a*-130*f* are present between the second lands 128*a*-128*c* and the first lands 120*a*-120*c*. Windows 130*a*-130*f* are either defined by the outer wall 127 of a second shoulder 122 of the second lands 128*a*-128*c* and the first wall 131 of the first lands 120*a*-120*c*; or an outer wall 125 of a first shoulder 121 of the second land 128*a*-128*c* and a second wall 132 of the first land 120*a*-120*c*. The windows 130*a*-130*f* allow additional material to be removed from the extruded pulley reducing the weight of the extruded pulley and the phaser as a complete package.

Figure 5:
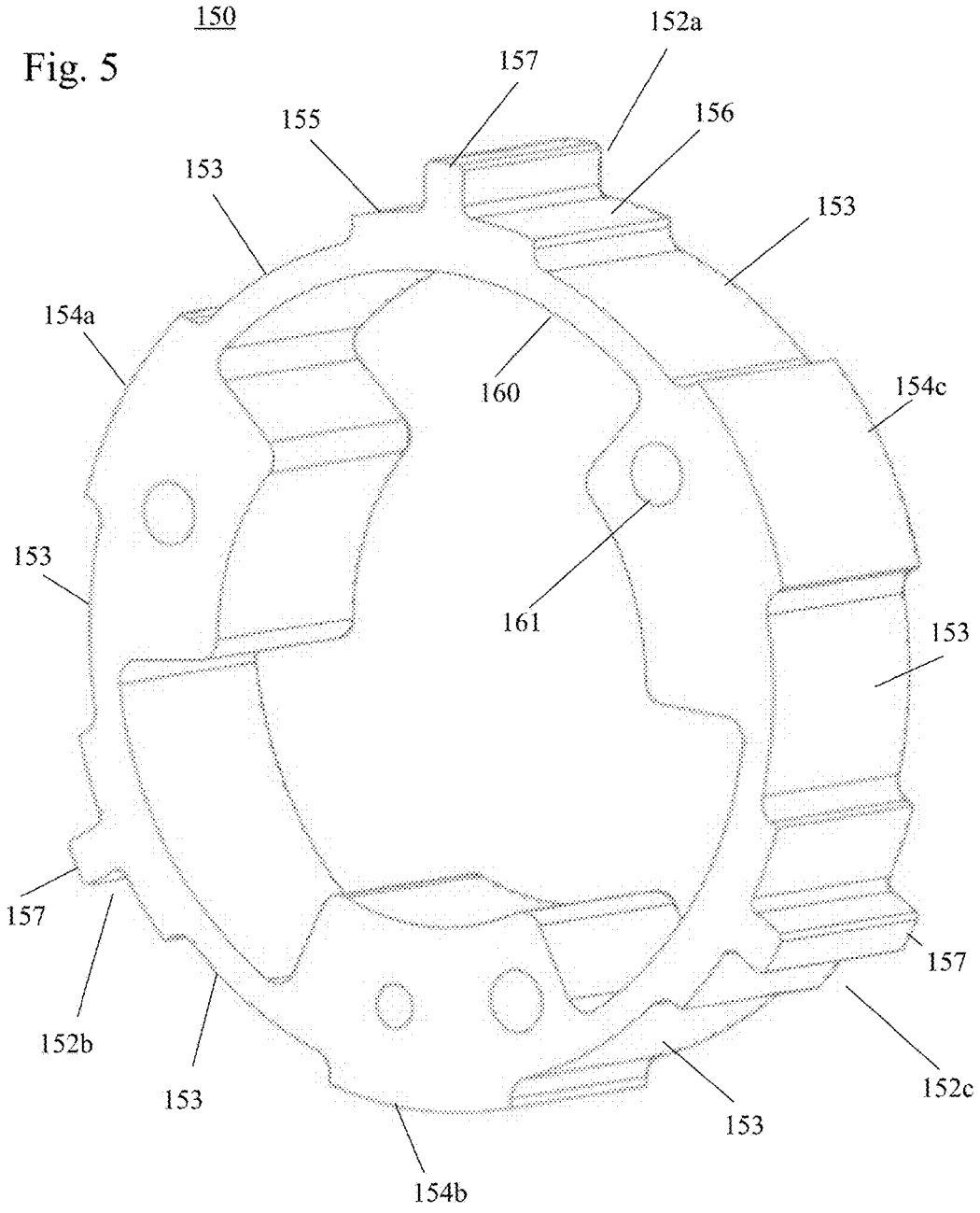
FIG. 5 shows a perspective view of a housing with keys which are received by keyways within the extruded pulley.

The housing 150 received within the extruded pulley is shown in FIG. 5. The housing 150 has housing key lands 152*a*-152*c* formed on an outer circumference for each of the keyways 123 of the extruded pulley 101. The key lands 152*a*-152*c* each have shoulders 155 and 156. Between the keys 157 are raised lands 154*a*-154*c* on the outer circumference of the housing 150 which mate with the first lands 120*a*-120*c*. Also present on the outer circumference of the housing 150 are portions 153 on the outer circumference which are not raised and are aligned with the windows 130*a*-130*f*. The inner portion 160 of the housing 150 is shaped to receive a rotor (not shown) of a phaser. It should be noted that the shape of the inner portion 160 of the housing 150 may vary based on the number of vanes of the rotor and other factors.

Bolt holes 161 are present within the housing 150 to connect the housing 150 to end plates (not shown) of the phaser. The placement of the bolt holes 161 within the housing 150 is for exemplary purposes only and the bolt holes 161 may be located anywhere within the housing 150 based on the design of the phaser.

Figure 6:
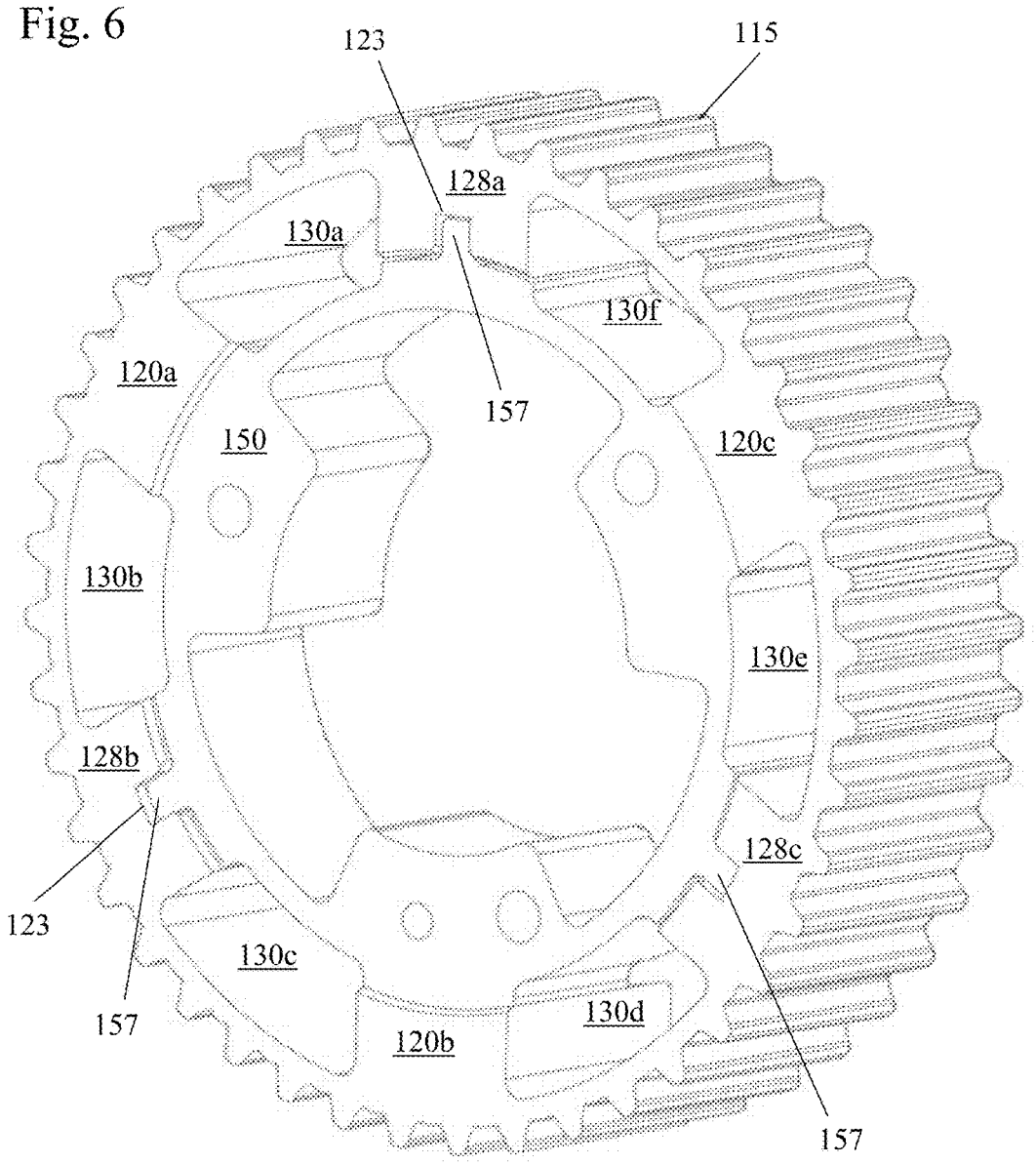
FIG. 6 shows a perspective view of an extruded pulley press fit over a housing such that the housing is retained within the extruded pulley axially through keys received within keyways.
Figure 7:
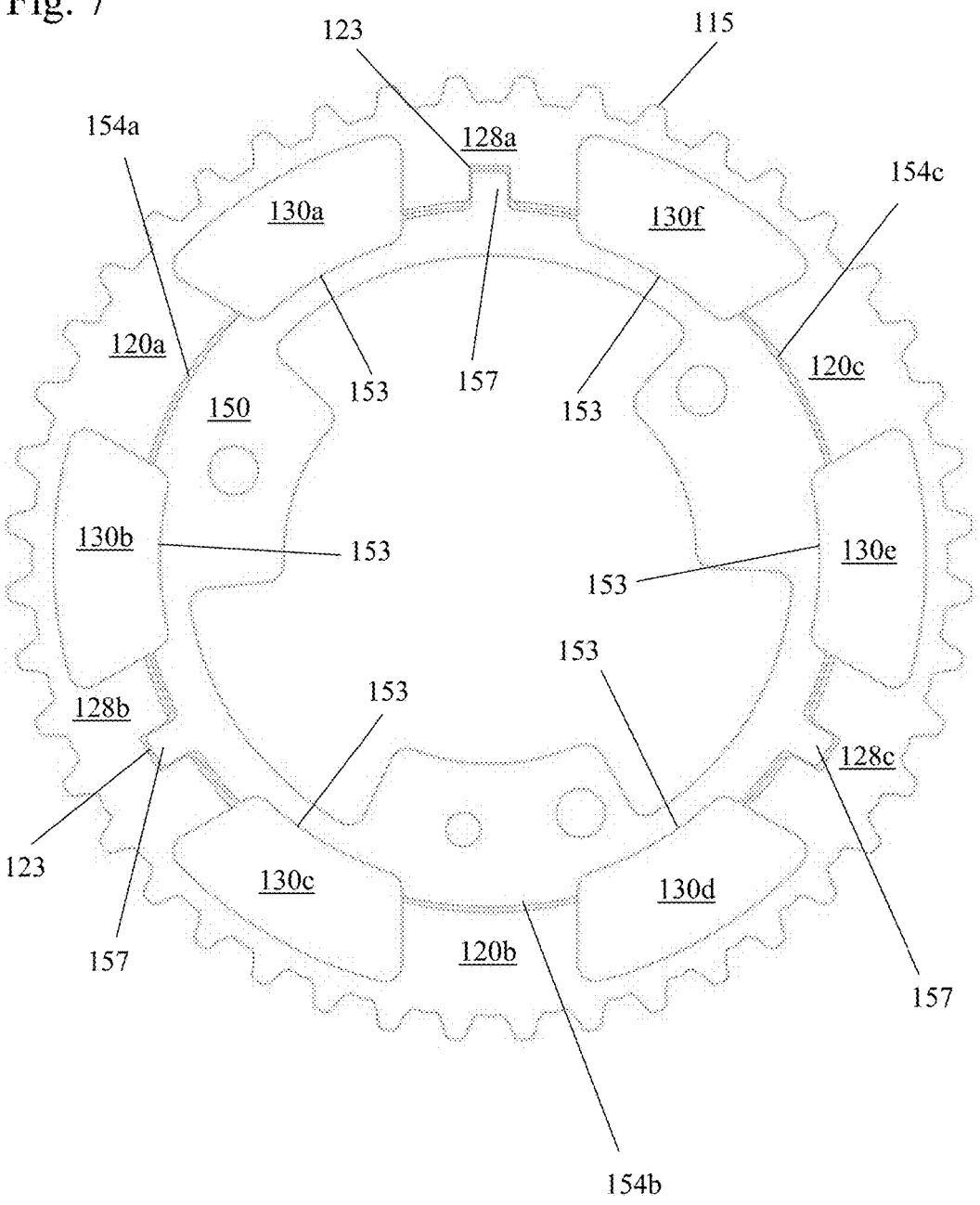
FIG. 7 shows a front view of FIG. 6.

FIGS. 6-7 shows the housing 150 press fit and axially retained within the extruded pulley 101.

The keys 157 of the housing 150 are received by the keyways 123 of the extruded pulley 101 and the shoulders 122, 121 of the keyways 123 mate with the shoulders 155, 156 of the key lands 152*a*-152*c*. When the keys 157 are press fit into the keyways 123, the unraised portions 153 on the outer circumference of the housing 150 form a complete cavity or window 130*a*-130*f*. The raised portions 154*a*-154*c* of the housing 150 mate with the first lands 120*a*-120*c* of the extruded pulley 101.

While three lands with keyways and associated keys are shown in this embodiment, it is understood by a person skilled in the art that any number of keys and associated lands with keyways could be used to retain and press fit the housing to the extruded pulley. Furthermore, the placement lands and associated keyways may also vary from what is shown, as long as the housing is retained within the extruded pulley.

FIGS. 8-12 shows an extruded pulley press fit over a housing such that a housing of a phaser is retained within the extruded pulley axially through a plurality of dovetail joints.

Figure 8:
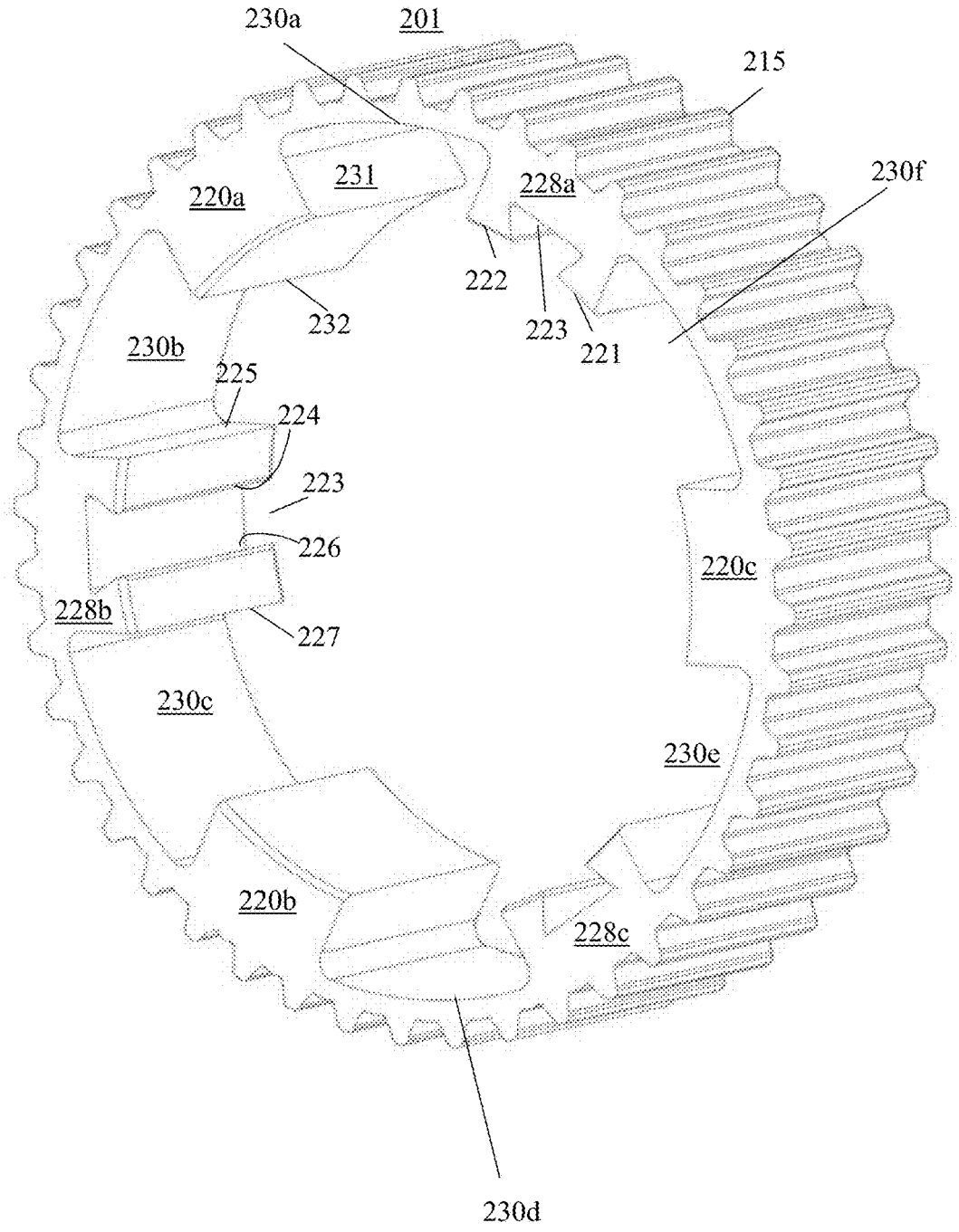
FIG. 8 shows a perspective view of an extruded pulley with a plurality of pin sockets for receiving a plurality of tails of a housing of a phaser.
Figure 9:
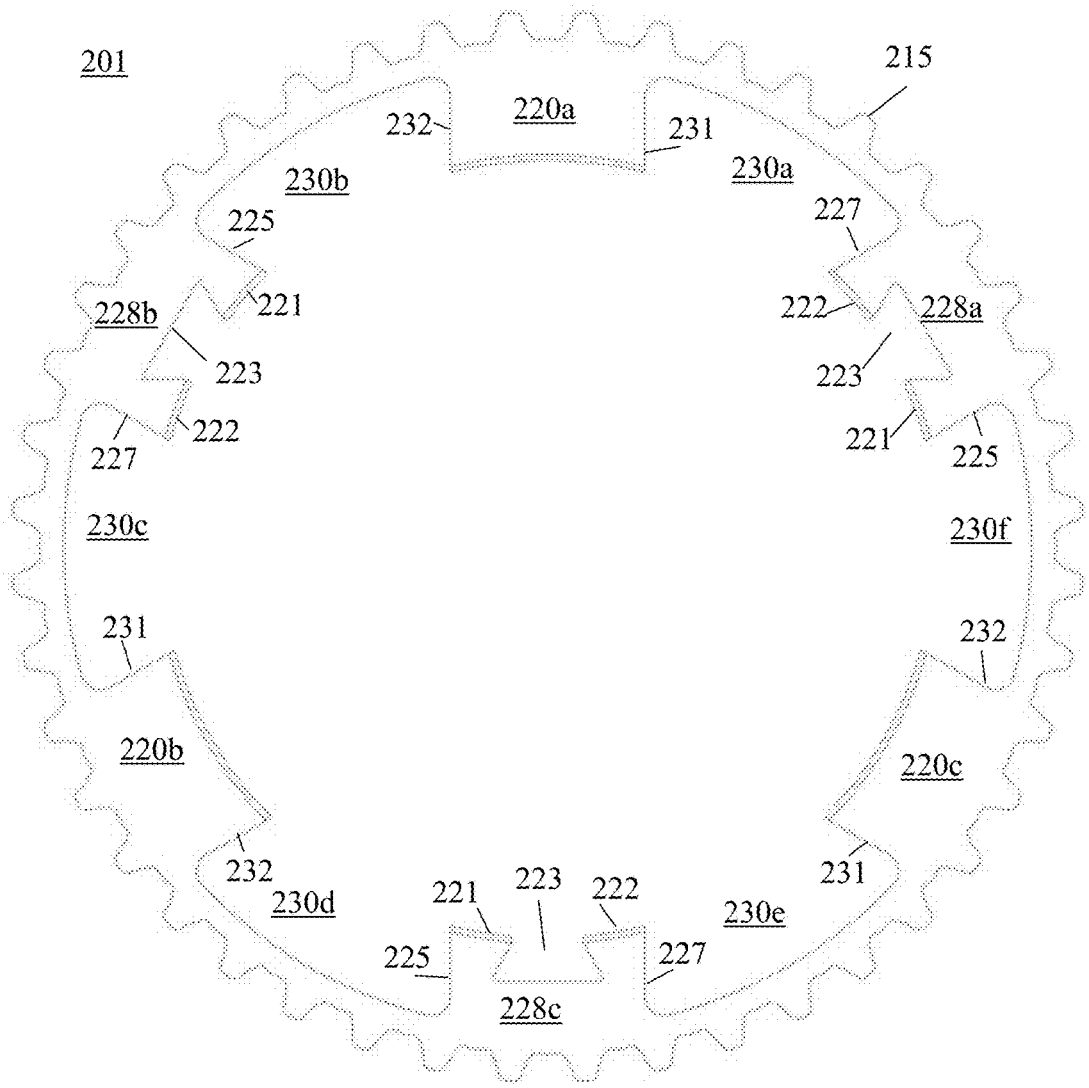
FIG. 9 shows a front view of FIG. 8.

FIGS. 8 and 9 show an extruded pulley 201. The extruded pulley 201 has an outer circumference with a plurality of teeth 215 for accepting a drive force. The inner circumference of the extruded pulley has a plurality of first lands 220*a*-220*c*, and a plurality of second lands 228*a*-228*c* containing pin sockets 223. The lands 220*a*-220*c*, 228*a*-228*c* extend inwards from the inner circumference towards a center point of the extruded pulley 201.

The plurality of first lands 220*a*-220*c* have a first side wall 231 and a second side wall 232.

Each of the second lands 228*a*-228*c* contains a pin socket 223. The pin socket 223 is formed by walls of the two pin shoulders 221, 222. The first pin shoulder 221 has an outer wall 225 and an inner wall 224. The second pin shoulder 222 has an outer wall 227 and an inner wall 226. The pin socket 223 is formed by three walls, the inner wall 224 of the first pin shoulder 221, the inner wall 226 of the second pin shoulder 222, and a third wall 229 of the second land 228*a*-228*c*. The pin socket 223 receives a tail 257 formed on an outer circumference of a housing 250 shown in FIGS. 10-12.

The second lands 228*a*-228*c* and the first lands 220*a*-220*c* alternate within the inner circumference of the extruded pulley 201. Windows 230*a*-230*f* are present between the second lands 228*a*-228*c* and the first lands 220*a*-220*c*. Windows 230*a*-230*f* are either defined by the outer wall 227 of a second pin shoulder 222 of the second land 228*a*-228*c* and the first wall 231 of the first land 220*a*-220*c*; or an outer wall 225 of a first pin shoulder 221 of the second land 228*a*-228*c* and a second wall 232 of the first land 220*a*-220*c*. The windows 230*a*-230*f* allow additional material to be removed from the extruded pulley reducing the weight of the extruded pulley and thus the weight of the phaser as a complete package.

Figure 10:
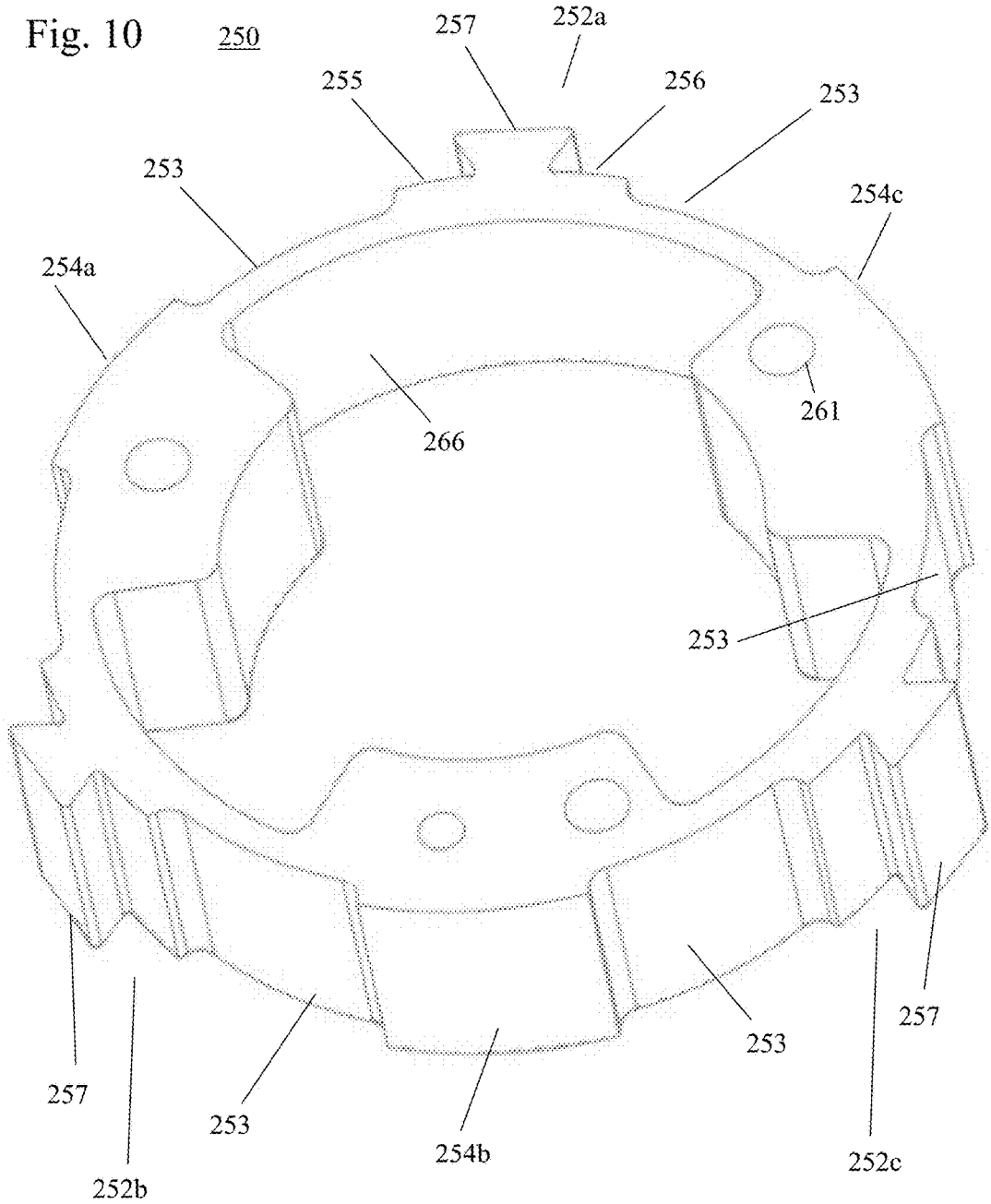
FIG. 10 shows a perspective view of a housing with a plurality of tails received by and press fit into the plurality of pin sockets of the extruded pulley.

The housing 250 received within the extruded pulley is shown in FIG. 10. The housing 250 has housing tail lands 252*a*-252*c* formed on an outer circumference for each of the pin sockets 223 of the extruded pulley 201. The housing tail lands 252*a*-252*c* each have shoulders 255 and 256. Between the tails 257 are raised lands 254*a*-254*c* on the outer circumference of the housing 250 which mate with the first lands 220*a*-220*c*. Also present on the outer circumference of the housing 250 are portions 253 on the outer circumference which are not raised and are aligned with the windows 230*a*-230*f*. The inner portion 266 of the housing 250 is shaped to receive a rotor (not shown) of a phaser. It should be noted that the shape of the inner portion 266 of the housing 250 may vary based on the number of vanes of the rotor and other factors.

Bolt holes 261 are present within the housing 250 to connect the housing 250 to end plates (not shown) of the phaser. The placement of the bolt holes 261 within the housing 250 is for exemplary purposes only and the bolt holes 261 may be located anywhere within the housing based on the design of the phaser.

Figure 11:
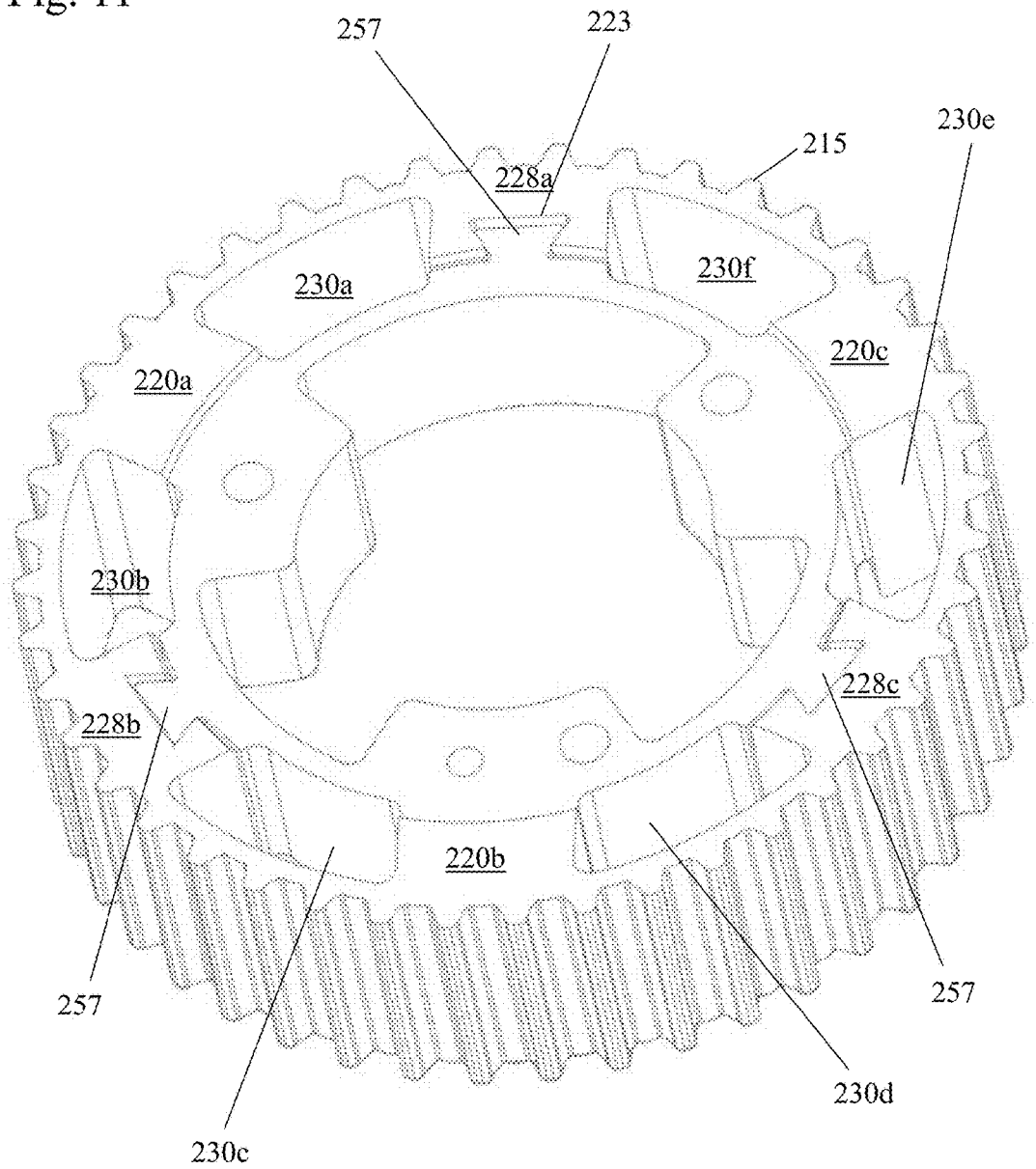
FIG. 11 shows a perspective view of an extruded pulley press fit over a housing such that the housing is retained within the extruded pulley axially through a plurality of dovetail joints.
Figure 12:
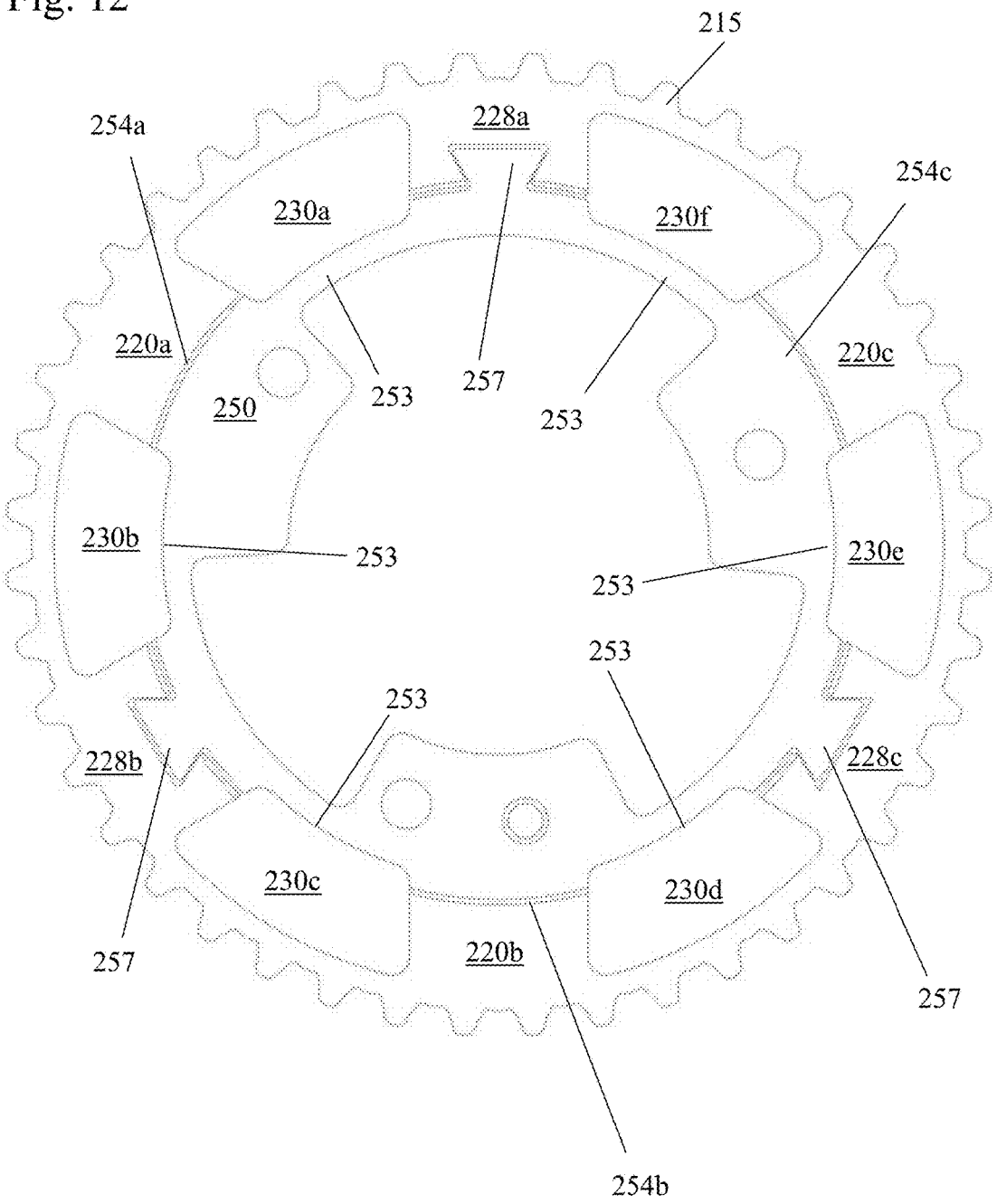
FIG. 12 shows a front view of FIG. 11.

FIGS. 11-12 shows the housing 250 press fit and axially retained within the extruded pulley 201.

The tails 257 of the housing 250 are received by the pin sockets 223 of the extruded pulley 201 and the pin shoulders 222, 221 of the pin sockets 223 mate with the shoulders 255, 256 of the housing tail lands 252*a*-252*c* to form a dovetail joint. When the tails 257 are press fit into the pin sockets 223, the unraised portions 253 on the outer circumference of the housing 250 sealing the complete cavity or window 230*a*-230*f*. The raised portions 254*a*-254*c* of the housing 250 mate with the first lands 220*a*-220*c* of the extruded pulley 201.

While three pin sockets and associated tails are shown in this embodiment, it is understood by a person skilled in the art that any number of tails and associated pin sockets forming a dovetail joint could be used to retain and press fit the housing to the extruded pulley.

FIGS. 13-17 shows an extruded pulley press fit over a housing such that the housing is retained within the extruded pulley axially 301 through three dovetail joints. The difference between FIGS. 8-12 and FIGS. 13-17 is the absence of lands without pin sockets alternating with the lands with pin sockets. Furthermore, the number of windows or cavities formed is decreased.

Figure 13:
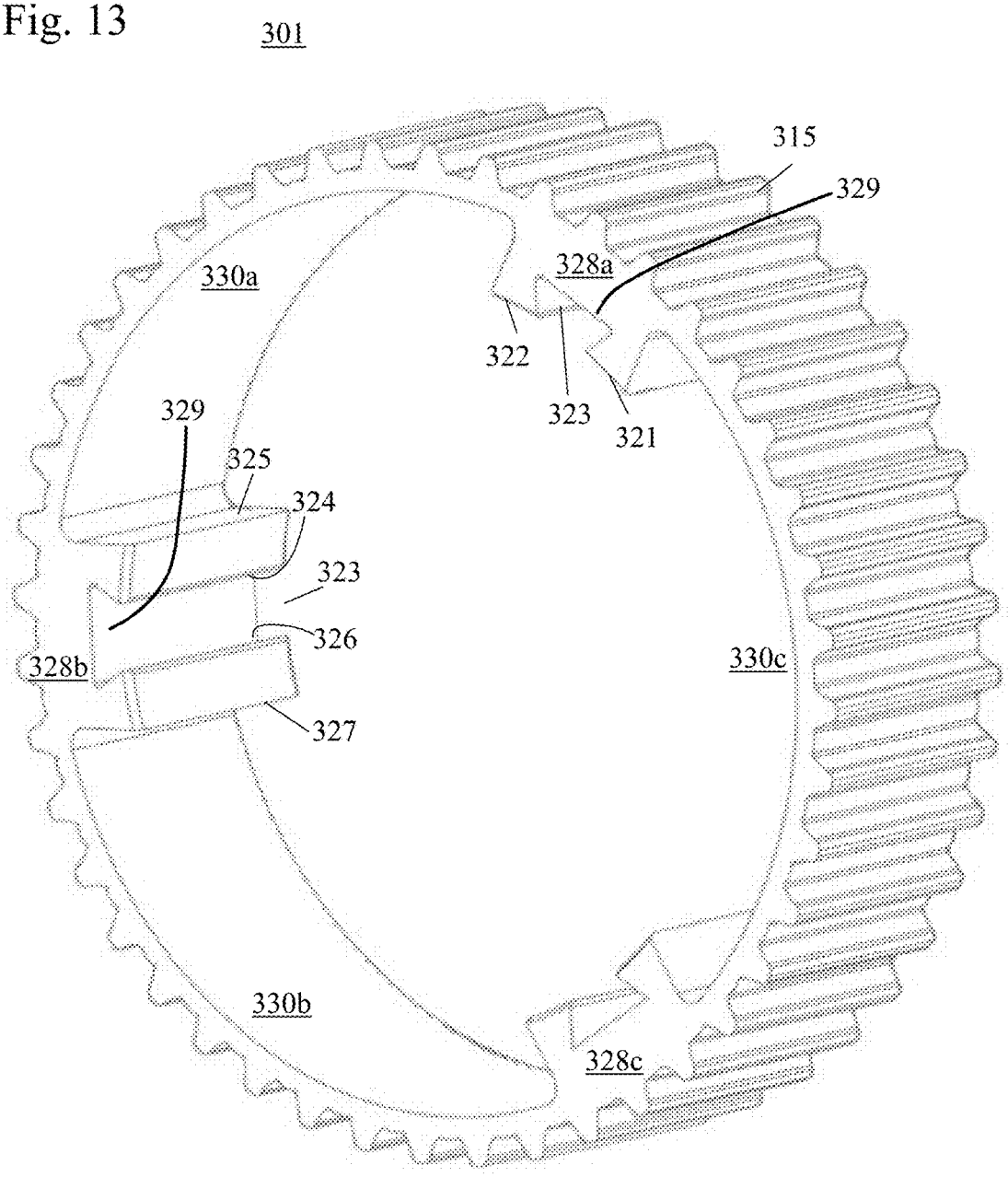
FIG. 13 shows a perspective view of an extruded pulley with three pin sockets.
Figure 14:
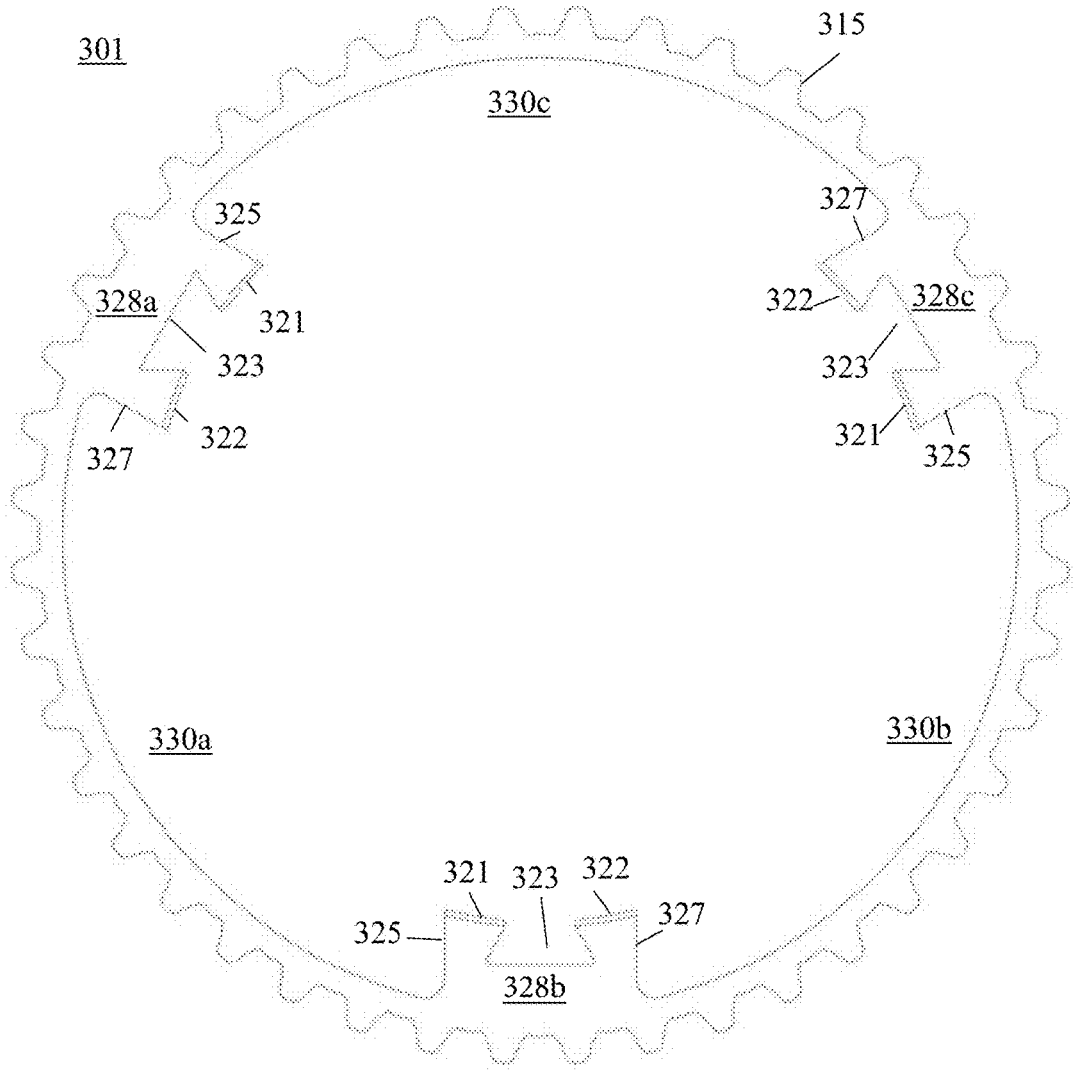
FIG. 14 shows a front view of FIG. 13.

FIGS. 13 and 14 show an extruded pulley 301. The extruded pulley 301 has an outer circumference with a plurality of teeth 315 for accepting a drive force. The inner circumference of the extruded pulley 301 has a plurality of lands 328*a*-328*c* containing pin sockets 323. The lands

328*a*-328*c* extend inwards from the inner circumference towards a center point of the extruded pulley 301.

Each of the lands 328*a*-328*c* contains a pin socket 323. The pin socket 323 is formed by walls of the two pin shoulders 321, 322. The first pin shoulder 321 has an outer wall 325 and an inner wall 324. The second pin shoulder 322 has an outer wall 327 and an inner wall 326. The pin socket 323 is formed by three walls: the inner wall 324 of the first pin shoulder 321, the inner wall 326 of the second pin shoulder 322, and a third wall 329 of the land 328*a*-328*c*. The pin socket 323 receives a tail 357 formed on an outer circumference of a housing 350 shown in FIGS. 15-17.

Three large windows 330*a*-330*c* are present between the lands 328*a*-328*c*. Windows 330*a*-330*c* are defined by the outer wall 327 of a second pin shoulder 322 of a land 328*a*-328*c* and the outer wall 325 of a first pin shoulder 321 of another land 328*a*-328*c*. The windows 330*a*-330*c* allow additional material to be removed from the extruded pulley reducing the weight of the extruded pulley and the total weight of the phaser as a complete package.

Figure 15:
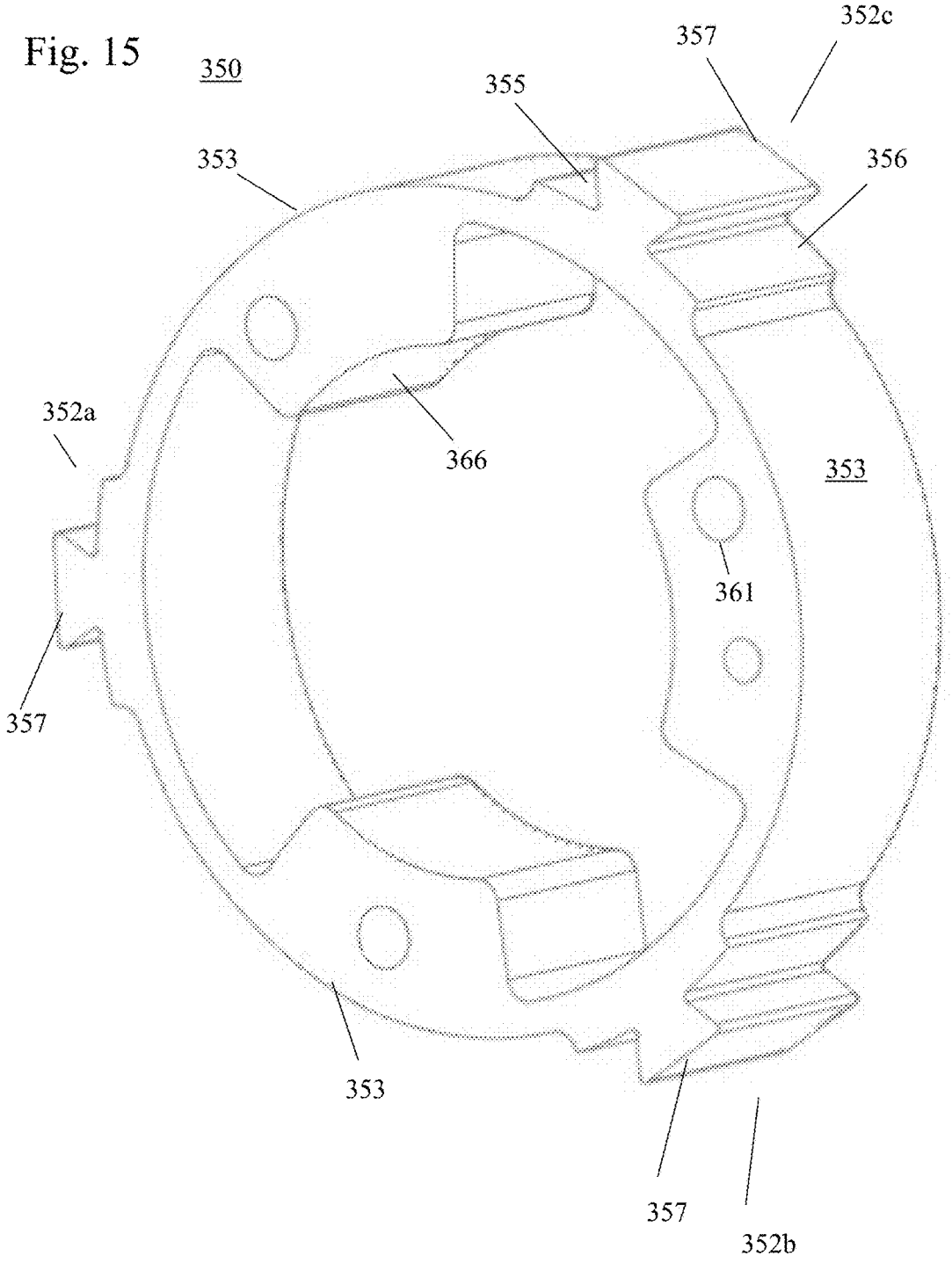
FIG. 15 shows a perspective view of a housing with three tails received by and press fit into the three pin sockets of the extruded pulley.

The housing 350 received within the extruded pulley is shown in FIG. 15. The housing 350 has housing tail lands 352*a*-352*c* formed on an outer circumference for each of the pin sockets 323 of the extruded pulley 301. The housing tail lands 352*a*-352*c* each have shoulders 355 and 356. Between the tail lands 352*a*-352*c* are portions 353 on the outer circumference which are not raised and are aligned with the windows 330*a*-330*c*. The inner portion 366 of the housing 350 is shaped to receive a rotor (not shown) of a phaser. It should be noted that the shape of the inner portion 366 of the housing 350 may vary based on the number of vanes of the rotor and other factors.

Bolt holes 361 are present within the housing 350 to connect the housing 350 to end plates (not shown) of the phaser. The placement of the bolt holes 361 within the housing 350 is for exemplary purposes only and the bolt holes 361 may be located anywhere within the housing based on the design of the phaser.

Figure 16:
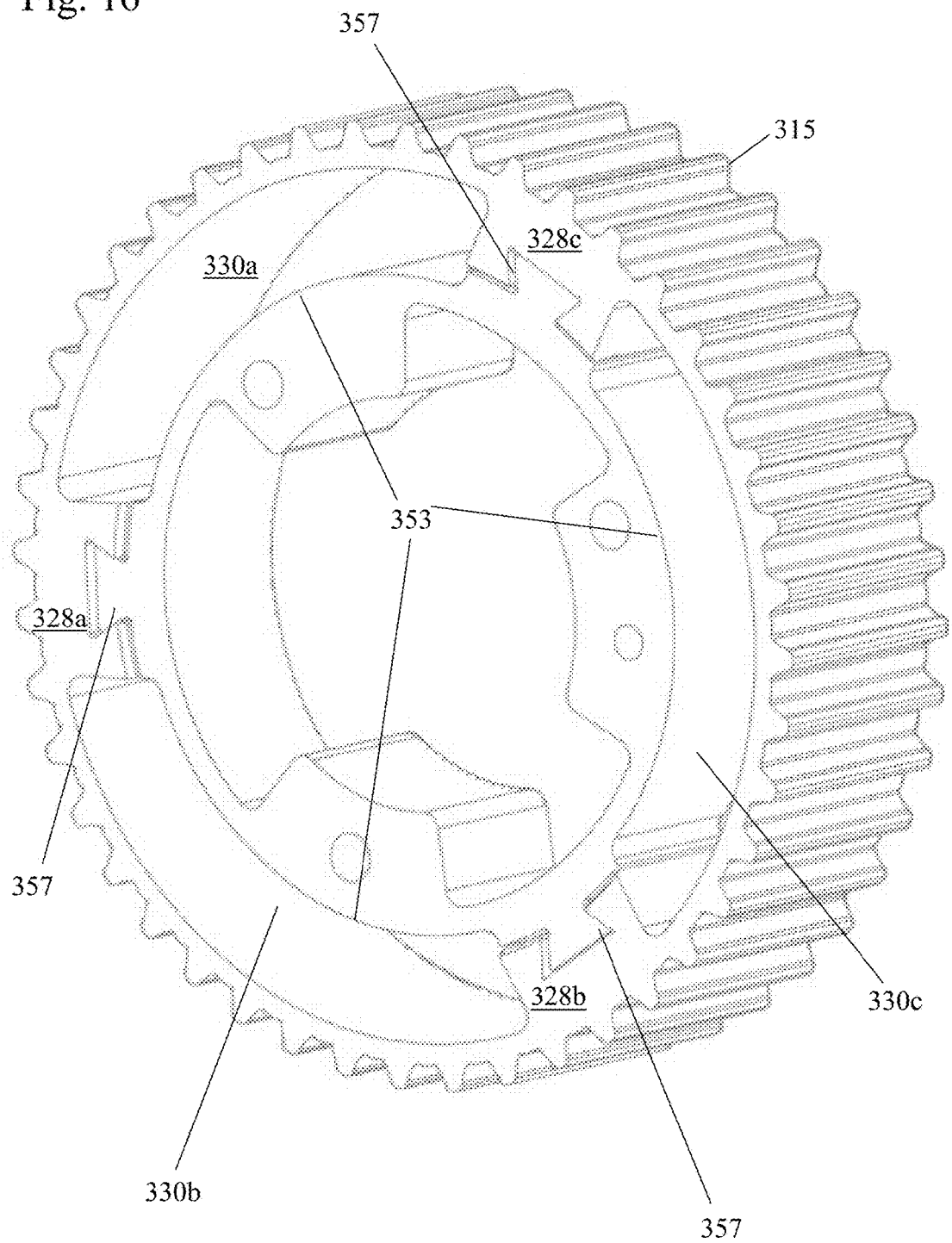
FIG. 16 shows a perspective view of an extruded pulley press fit over a housing such that the housing is retained within the extruded pulley axially through three dovetail joints.
Figure 17:
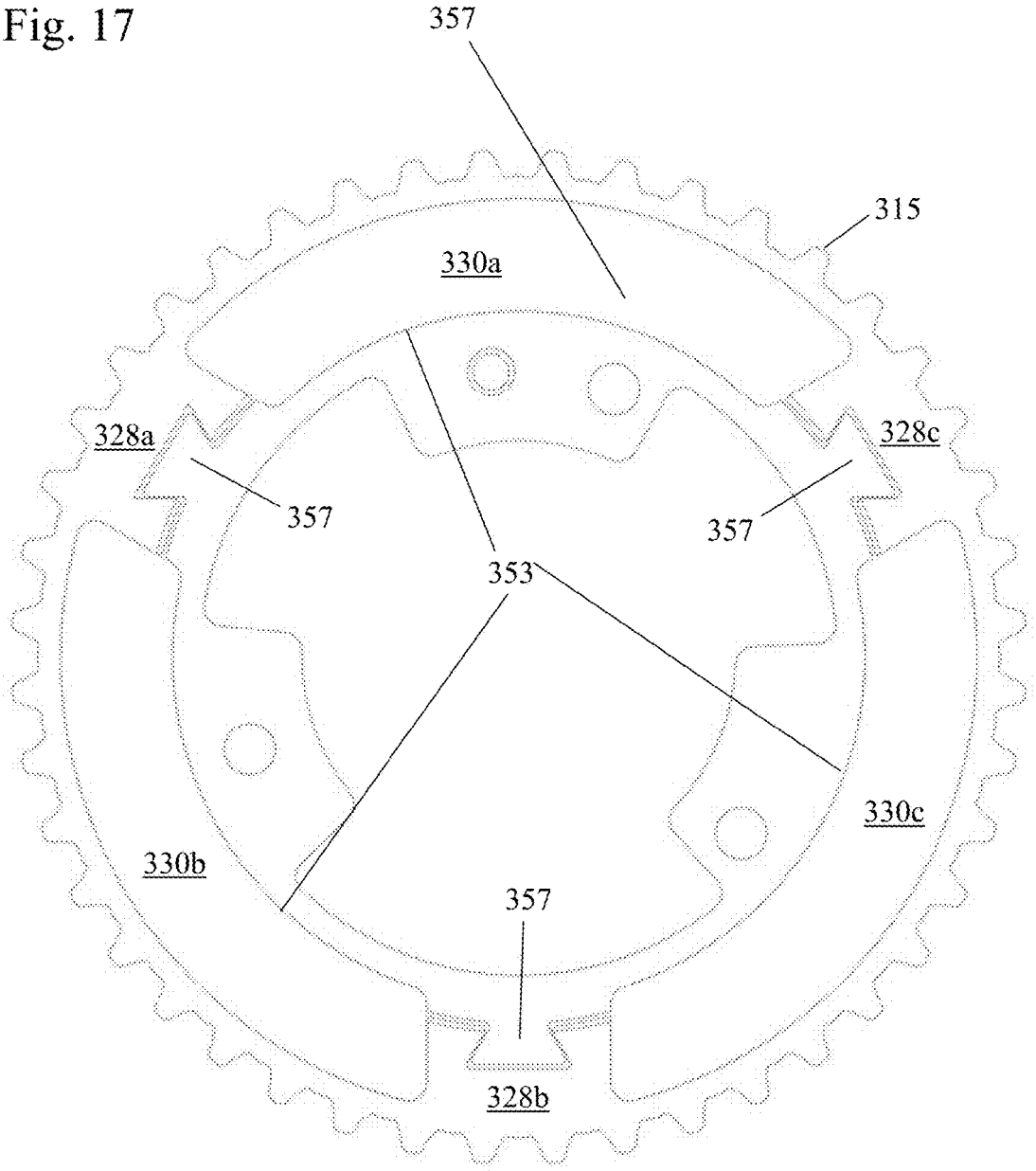
FIG. 17 shows a front view of FIG. 16.

FIGS. 16-17 shows the housing 350 press fit and axially retained within the extruded pulley 301.

The tails 357 of the housing 350 are received by the pin sockets 323 of the extruded pulley 301 and the pin shoulders 322, 321 of the pin sockets 323 mate with the shoulders 355, 356 of the tail lands 352*a*-352*c* to form dovetail joints. When the tails 357 are press fit into the pin sockets 323, the unraised portions 353 on the outer circumference of the housing 350 seal and form a complete cavity or window 330*a*-330*c*.

While three pin sockets and associated tails are shown in this embodiment, it is understood by a person skilled in the art that any number of tails and associated pin sockets forming a dovetail joint could be used to retain and press fit the housing to the extruded pulley.

FIGS. 18-22 shows an extruded pulley press fit over a housing such that the housing is retained within the extruded pulley axially through splines.

Figure 18:
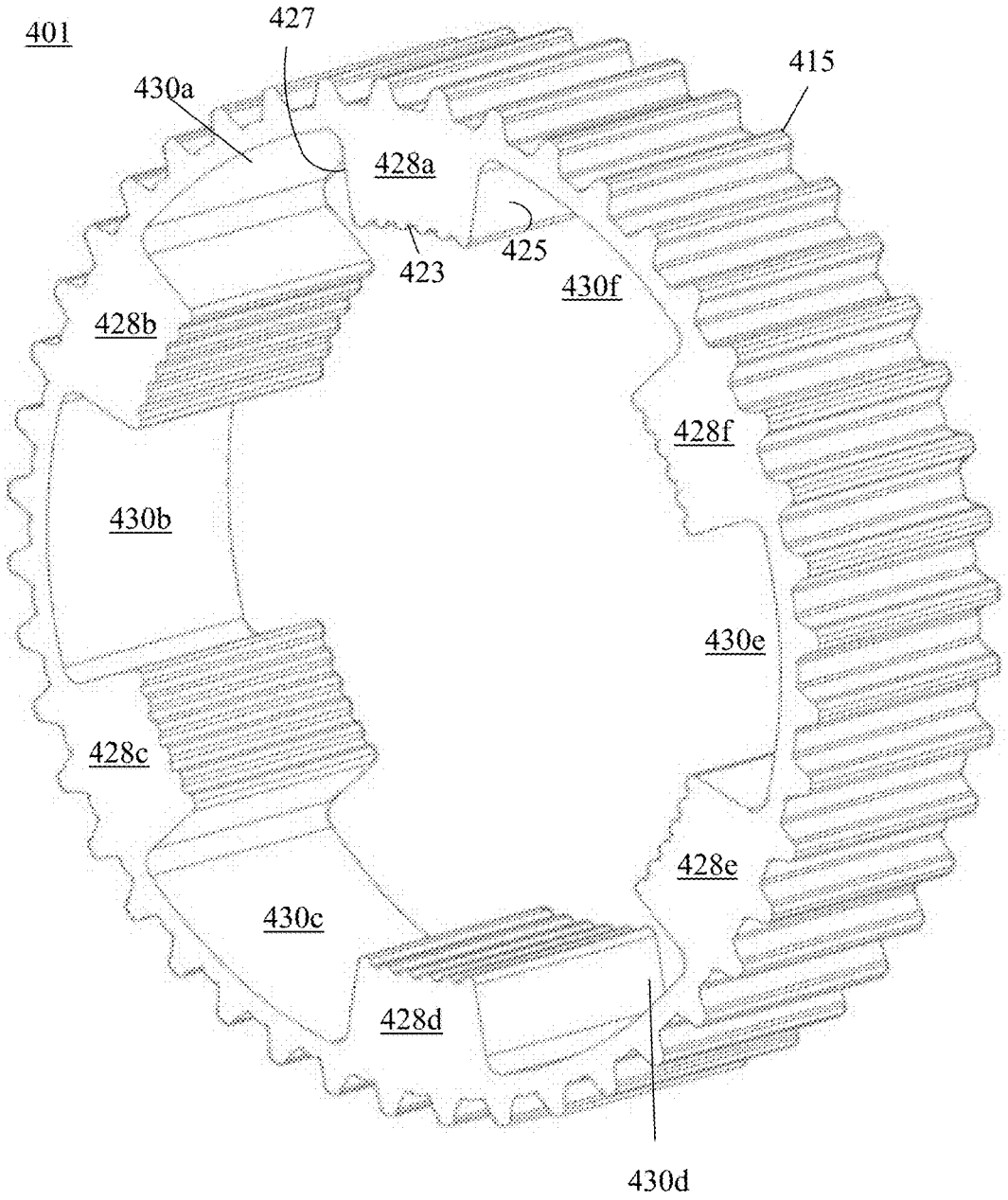
FIG. 18 shows a perspective view of an extruded pulley with a plurality of spline edges.
Figure 19:
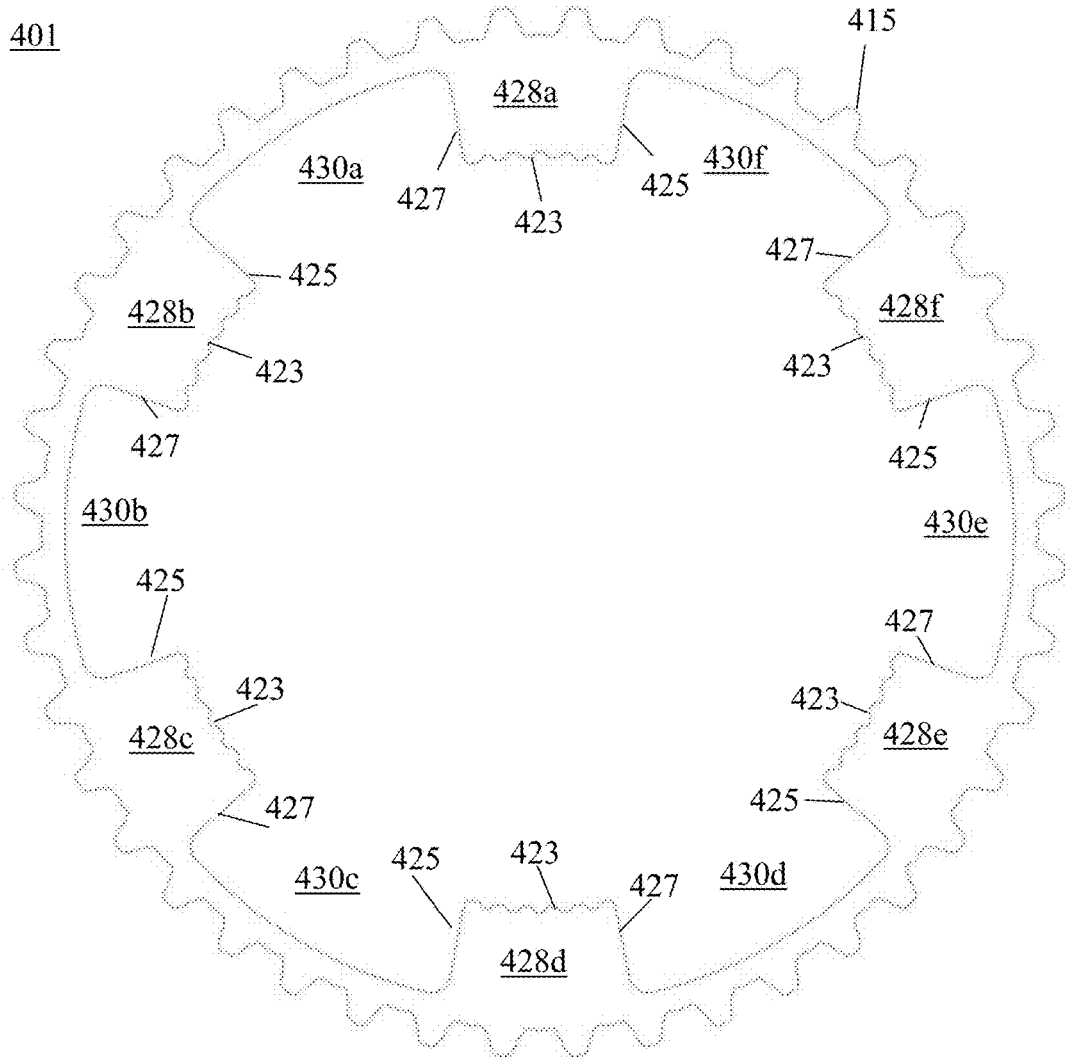
FIG. 19 shows a front view of FIG. 18.

FIGS. 18 and 19 show an extruded pulley 401. The extruded pulley 401 has an outer circumference with a plurality of teeth 415 for accepting a drive force. The inner circumference of the extruded pulley has a plurality of lands 428*a*-428*f* containing splines 423. The lands 428*a*-428*f* extend inwards from the inner circumference towards a center point of the extruded pulley 401.

Lands 428*a*-428*f* each have a first wall 425 and a second wall 427 as shown in FIGS. 18-19. A plurality of windows 430*a*-430*f* are present between the lands 428*a*-428*f*. Windows 430*a*-430*f* are defined by the second wall 427 of a land 428*a*-428*f* and a first wall 425 of another land 428*a*-428*f*. The windows 430*a*-430*f* allow additional material to be removed from the extruded pulley reducing the weight of the extruded pulley and reduce the weight of the phaser as a complete package.

Figure 20:
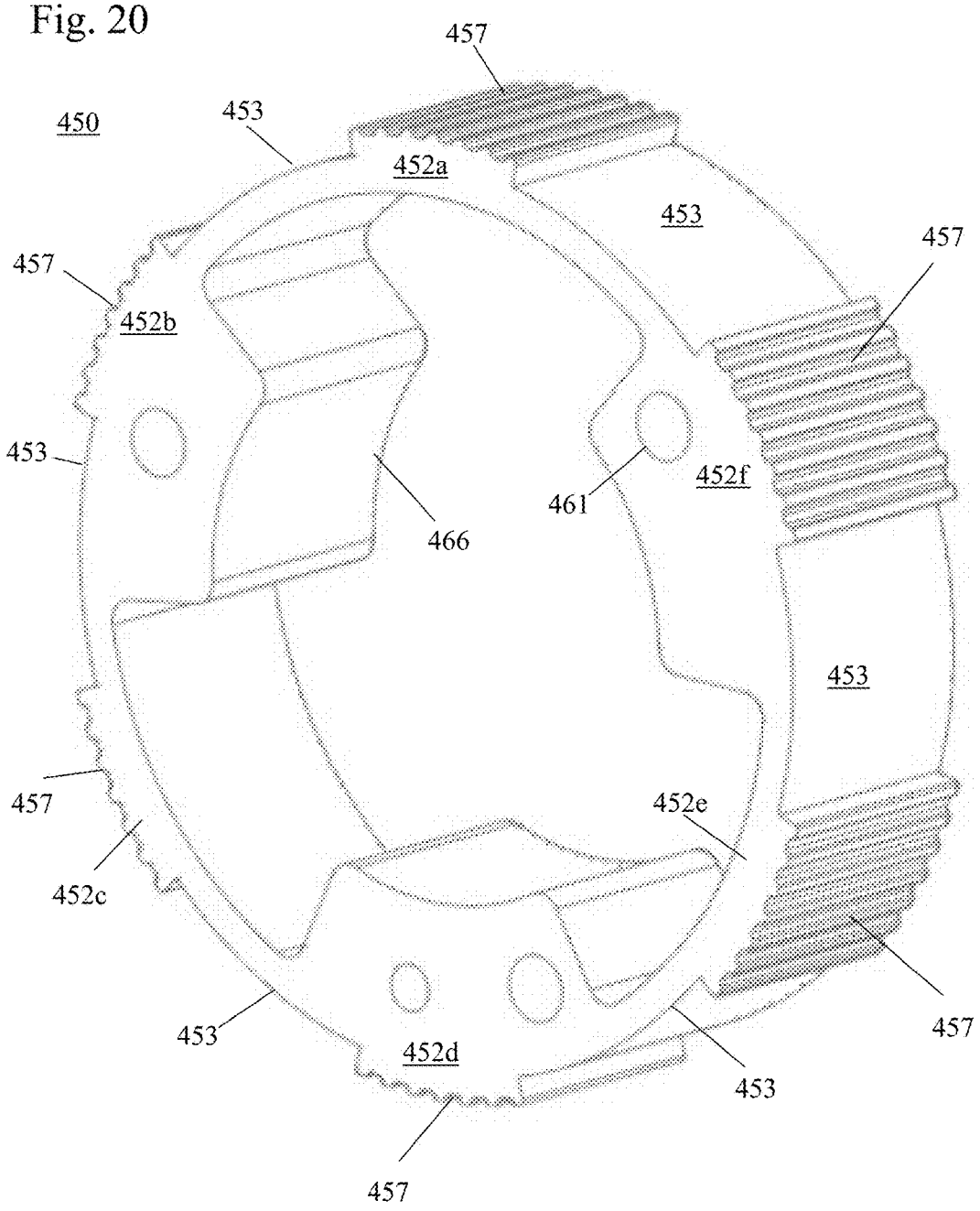
FIG. 20 shows a perspective view of a housing with corresponding splines for meshing with the splined edges of the extruded pulley.

The housing 450 received within the extruded pulley 401 is shown in FIG. 20. The housing 450 has spline lands 452*a*-452*f* formed on an outer circumference which mesh with the splines 423 of lands 428*a*-428*f* of the extruded pulley 401. Between the spline lands 452*a*-452*c* are portions 453 on the outer circumference which are not raised and are aligned with the windows 430*a*-430*f*. The inner portion 466 of the housing 450 is shaped to receive a rotor (not shown) of a phaser. It should be noted that the shape of the inner portion 466 of the housing 450 may vary based on the number of vanes of the rotor and other factors.

Bolt holes 461 are present within the housing 450 to connect the housing 450 to end plates (not shown) of the phaser. The placement of the bolt holes 461 within the housing 450 is for exemplary purposes only and the bolt holes 461 may be located anywhere within the housing 450 based on the design of the phaser.

Figure 21:
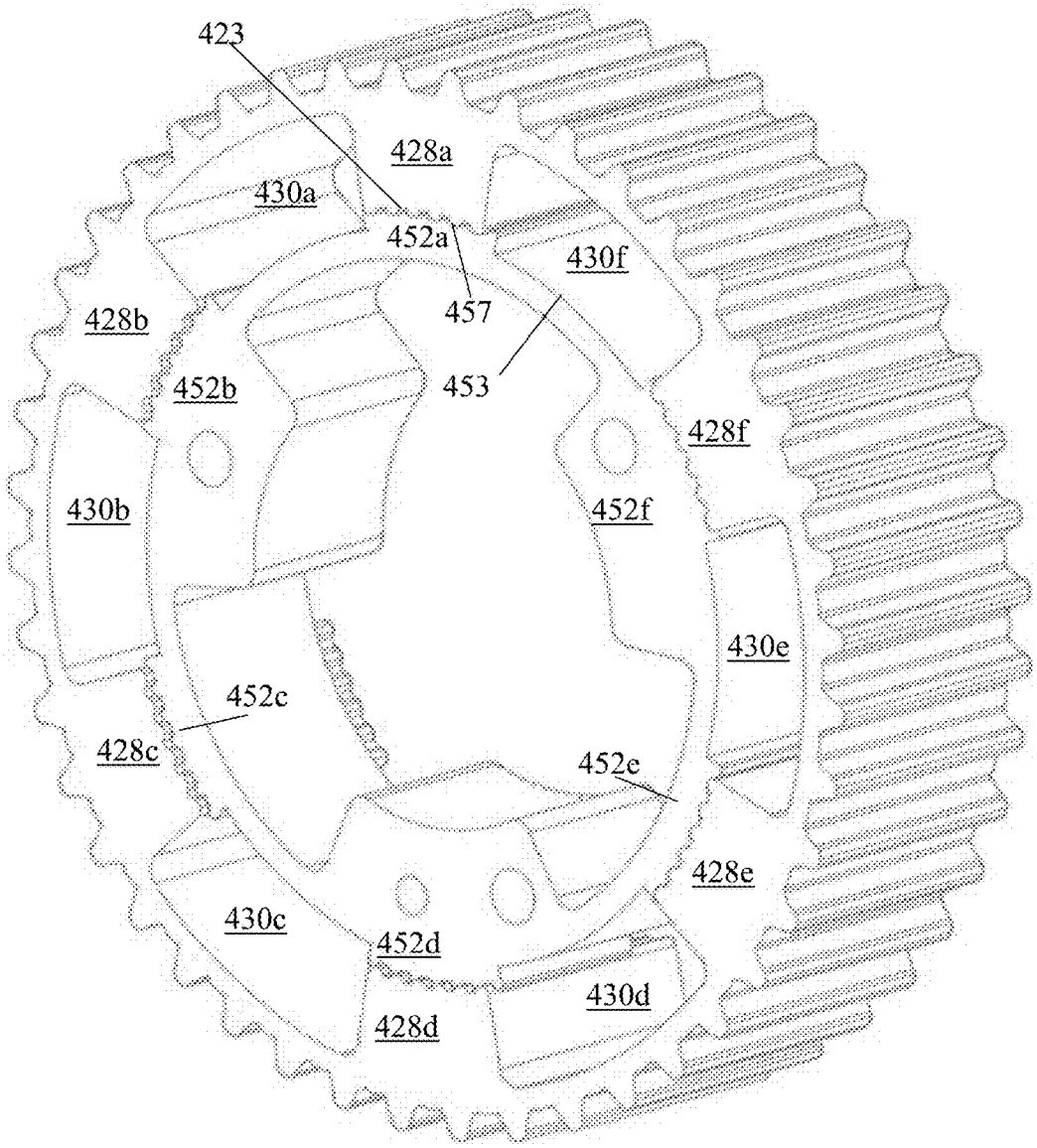
FIG. 21 shows a perspective view of an extruded pulley press fit over a housing such that the housing is retained within the extruded pulley axially through splines.
Figure 22:
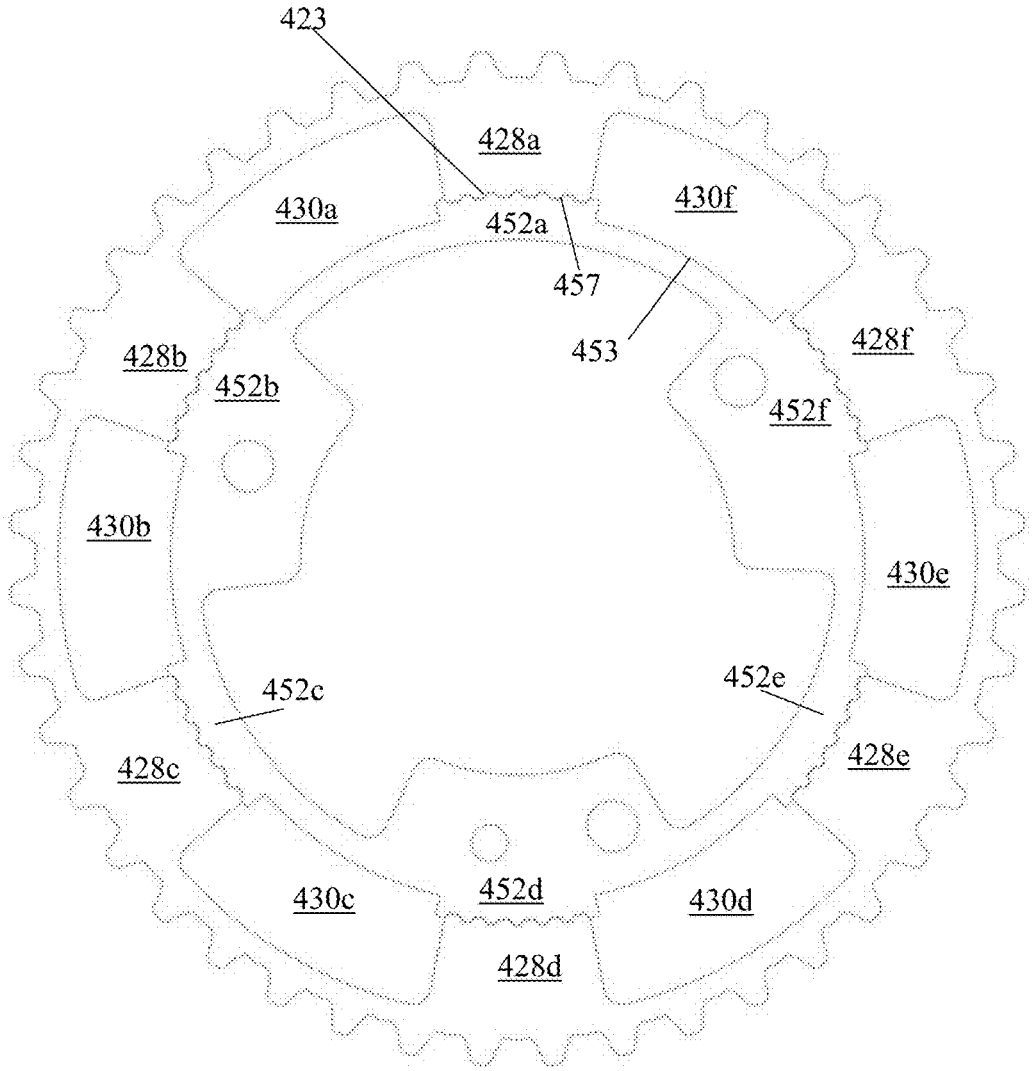
FIG. 22 shows a front view of FIG. 21.

FIGS. 21-22 shows the housing 450 press fit and axially retained within the extruded pulley 401.

The splines 457 of the housing mesh with splines 423 of the extruded pulley 401. When the splines 457 are press fit and meshed with splines 423, the unraised portions 453 on the outer circumference of the housing 450 form and seal complete cavity or window 430*a*-430*f*.

While six spline pairs are shown in this embodiment, it is understood by a person skilled in the art that any number of spline pairs could be used to retain and press fit the housing to the extruded pulley.

The splines of FIGS. 18-22 may be cut at a slight angle, such that when the splines of the housing slide fit with the splines of the extruded pulley, the backlash between the housing and the extruded pulley is approximately zero.

Figure 23:
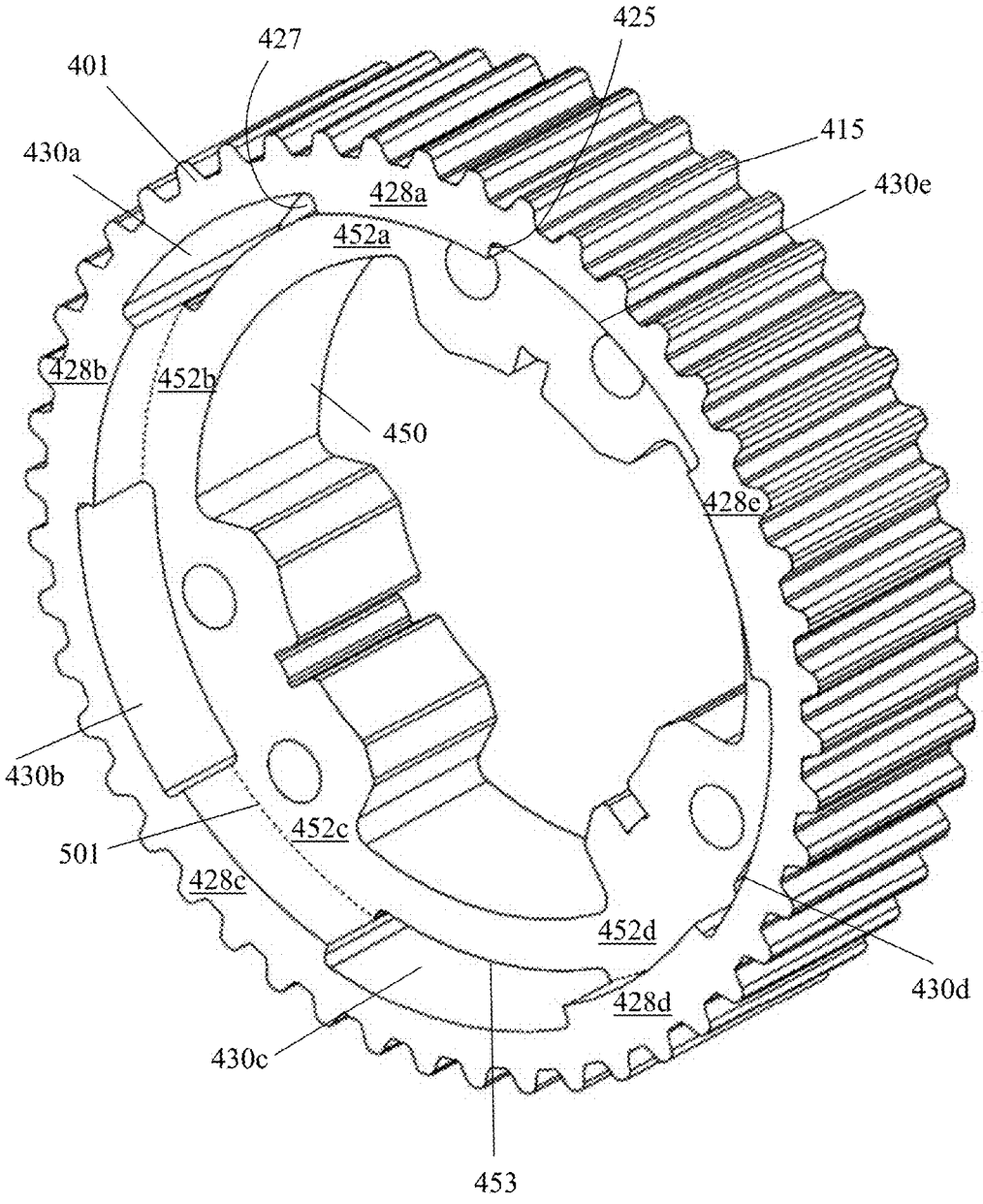
FIG. 23 shows a perspective view of an extruded pulley press fit over a housing such that the housing is retained within the extruded pulley axially through serrations on the housing.
Figure 24:
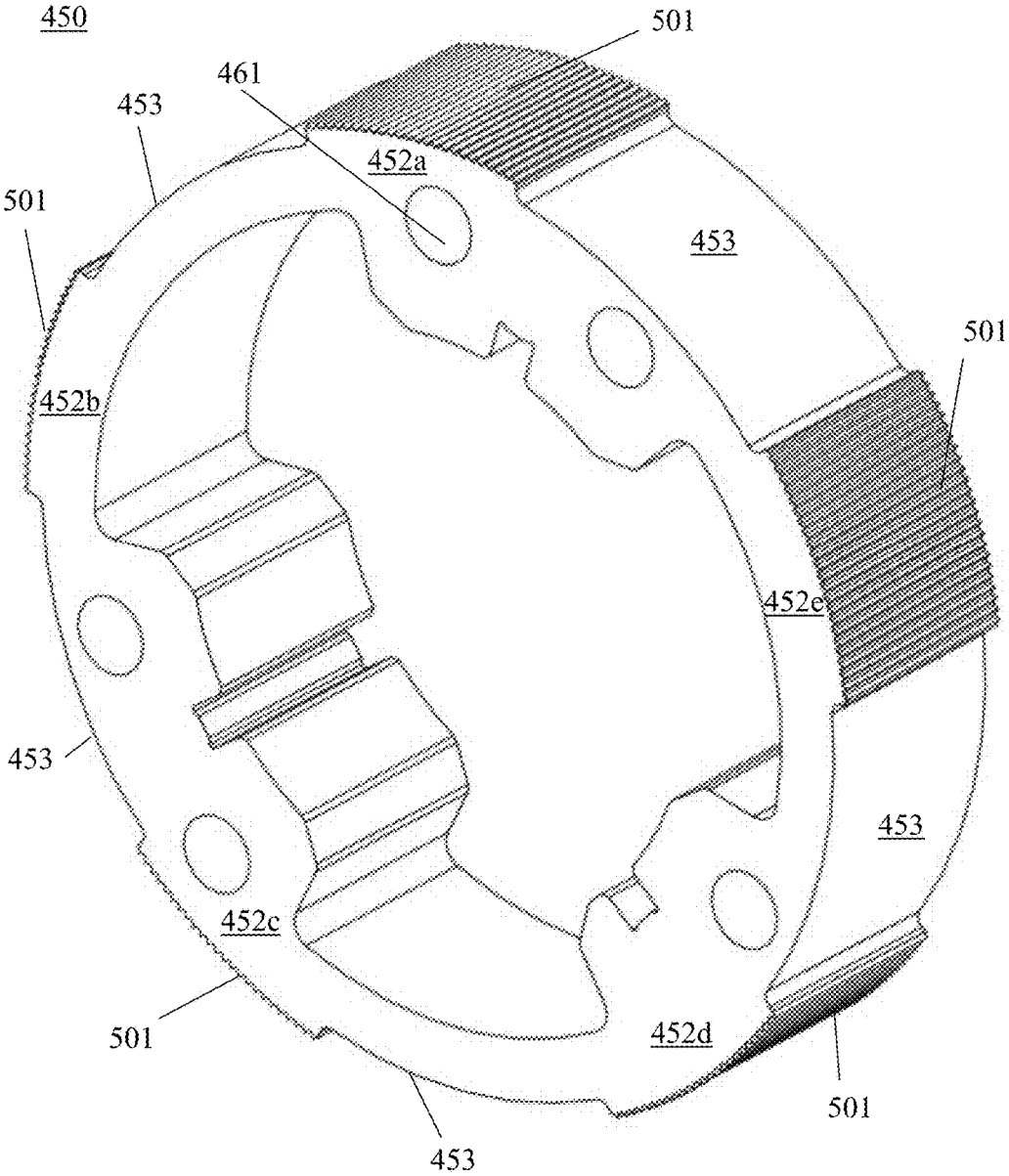
FIG. 24 shows a perspective view of a housing with corresponding serrations for meshing with the extruded pulley.
Figure 25:
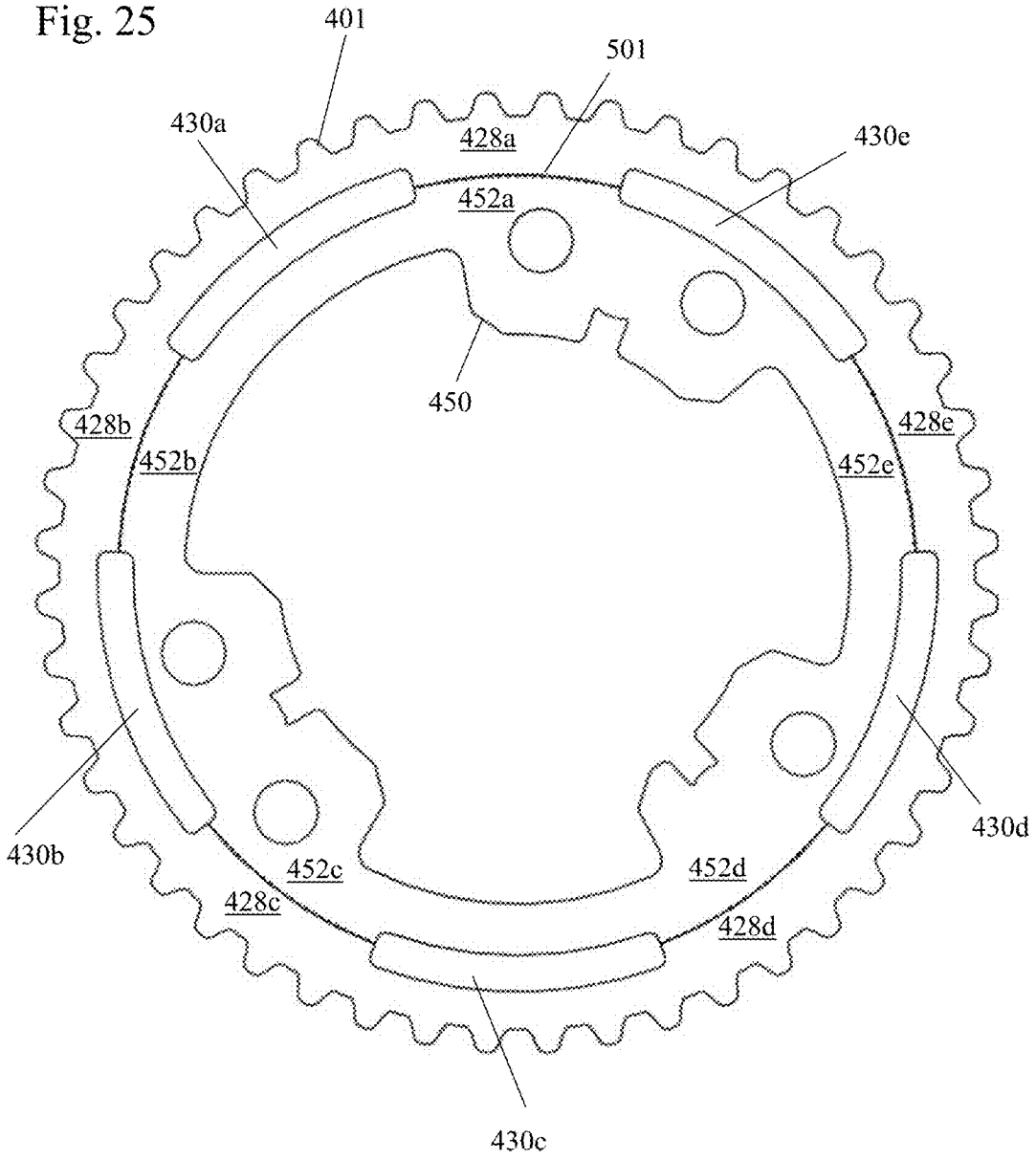
FIG. 25 shows a front view of an extruded pulley press fit over a housing such that the housing is retained within the extruded pulley axially through serrations on the pulley.

In an alternate embodiment, as shown in FIGS. 23-25, the splines 423, 457 of the housing 450 and the extruded pulley 401 may be replaced with serrations 501, where the serrations 501 are cut into a smooth diameter of one or both of the lands 452*a*-452*e* of housing 450 and the lands 428*a*-428*e* of the extruded pulley 401 when they are assembled.

In one alternate embodiment, as shown in FIGS. 23-24, the splines 457 of the housing 450 are replaced with serrations 501 and the splines 423 of the lands 428*a*-428*e* of the extruded pulley 401 are removed and the lands 428*a*-428*e* have a smooth diameter prior to being press fit together. When the housing 450 is press fit into the extruded pulley 401, the serrations 501 of the housing 450 cut the smooth diameter of the lands 428*a*-428*e* into corresponding, mating serrations.

In another alternate embodiment, as shown in FIG. 25, the splines 423 of the extruded pulley 401 are replaced with serrations 501 and the splines 457 of the lands 452*a*-452*e* of the housing 450 are removed and the lands 452*a*-452*e* have a smooth diameter prior to being press fit together. When the housing 450 is press fit into the extruded pulley 401, the serrations 501 of the extruded pulley 401 cut the smooth diameter of the lands 452*a*-452*e* into corresponding, mating serrations.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A pulley for a phaser comprising:

a toothed outer circumference for accepting a drive force;

an inner circumference with at least a first set of lands extending towards a center of the pulley and spaced apart along the inner circumference of the pulley; and an axial retaining feature on the first set of lands for interaction with a corresponding retaining feature of a housing press fit within the inner circumference of the pulley, axially retaining the housing within the pulley.

2. The pulley of claim 1, wherein the pulley is formed by extrusion and pressing.

3. The pulley of claim 1, wherein the axial retaining feature on the first set of lands of the pulley is a keyway and the corresponding retaining feature of the housing is a plurality of keys, such that when the housing is press fit into the pulley, each keyway receives one of the keys of the housing, axially maintaining the housing within the pulley.

4. The pulley of claim 1, wherein the axial retaining feature of the first set of lands of the pulley is a pin socket and the corresponding retaining feature of the housing is a plurality of tails, such that when the housing is press fit into the pulley, each pin socket receives a tail of the housing, forming a dovetail joint, axially maintaining the housing within the pulley.

5. The pulley of claim 1, wherein the axial retaining feature of the first set of lands of the pulley is a first spline and the corresponding feature of the housing is a second, complementary spline, such that when the housing is press fit into the pulley, the first and second splines mesh, axially maintaining the housing within to the pulley.

6. The pulley of claim 1, further comprising a second set of lands alternating with the first set of lands within the inner circumference of the pulley.

7. The pulley of claim 6, wherein cavities are formed between the first set of lands and the second set of lands.

8. The pulley of claim 1, wherein the housing comprises:

an inner circumference; and an outer circumference comprising:

the complementary retaining features spaced along an outer circumference of the housing; and a recessed portion between the complementary retaining features.

9. A phaser comprising:

a pulley comprising: a toothed outer circumference for accepting a drive force; an inner circumference with at least a first set of lands extending towards a center of the pulley and spaced apart along the inner circumference of the pulley; and an axial retaining feature on the first set of lands;

a housing received within the inner circumference of the pulley, the housing comprising: an inner circumference; and an outer circumference comprising: complementary retaining features spaced along an outer circumference of the housing for interaction with the axial retaining features on the first set of lands; and a recessed portion between the complementary retaining features; and a rotor received within the inner circumference of the housing.

10. The phaser of claim 9, wherein the housing is press fit within the inner circumference of the pulley.

11. The phaser of claim 9, wherein the pulley is formed by extrusion and pressing.

12. The phaser of claim 9, wherein the axial retaining feature on the first set of lands of the pulley is a keyway and the complementary retaining feature of the housing is a plurality of keys, such that when the housing is press fit into the pulley, each keyway receives a key of the plurality of keys of the housing, axially maintaining the housing within the pulley.

13. The phaser of claim 9, wherein the axial retaining feature of the first set of lands of the pulley is a pin socket and the complementary retaining feature of the housing is a plurality of tails, such that when the housing is press fit into the pulley, pin socket receives a tail of the plurality of tails of the housing, forming a dovetail joint, axially maintaining the housing within the pulley.

14. The phaser of claim 9, wherein the axial retaining feature of the first set of lands of the pulley is a first spline and the complementary feature of the housing is a second, complementary spline, such that when the housing is press fit into the pulley, the first and second splines mesh, axially maintaining the housing within to the pulley.

15. The phaser of claim 9, wherein the pulley further comprises a second set of lands alternating with the first set of lands within the inner circumference of the pulley.

16. The phaser of claim 15, wherein cavities are formed between the first set of lands, the second set of lands, and the recessed portions of the housing.

17. The phaser of claim 9, wherein the axial retaining features of the first set of lands of the pulley are serrations and the complementary retaining feature of the housing are complementary serrations, wherein the complementary serrations are formed when the housing is press fit into the pulley such that the serrations of the pulley cut a smooth diameter of the first set of lands of the housing.

18. The phaser of claim 9, wherein the axial retaining features of the first set of lands of the housing are serrations and the complementary retaining feature of the pulley are complementary serrations, wherein the complementary serrations are formed when the housing is press fit into the pulley such that the serrations of the housing cut a smooth diameter of the first set of lands of the pulley.

* * * * *